US010910781B2

(12) United States Patent
Iwadare

(10) Patent No.: US 10,910,781 B2
(45) Date of Patent: Feb. 2, 2021

(54) POWER PLUG CONVERSION UNIT

(71) Applicant: OLYMPUS CORPORATION, Hachioji (JP)

(72) Inventor: Akira Iwadare, Hachioji (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 16/533,874

(22) Filed: Aug. 7, 2019

(65) Prior Publication Data

US 2020/0091668 A1 Mar. 19, 2020

(30) Foreign Application Priority Data

Sep. 13, 2018 (JP) ..... 2018-171683
May 9, 2019 (JP) ..... 2019-089065

(51) Int. Cl.

| | |
|---|---|
| ***H01R 4/50*** | (2006.01) |
| ***H01R 31/06*** | (2006.01) |
| ***H01R 24/20*** | (2011.01) |
| ***H01R 24/28*** | (2011.01) |
| *H01R 103/00* | (2006.01) |

(52) U.S. Cl.
CPC ..... *H01R 31/065* (2013.01); *H01R 24/20* (2013.01); *H01R 24/28* (2013.01); *H01R 2103/00* (2013.01)

(58) Field of Classification Search
CPC ..... H01R 13/20; H01R 13/639
USPC ..... 439/346, 848, 849
See application file for complete search history.

(56) References Cited

U.S. PATENT DOCUMENTS

| | | | | |
|---|---|---|---|---|
| 2,846,530 A * | 8/1958 | George Wintriss .... | H01R 13/70 200/43.02 |
| 4,566,187 A * | 1/1986 | Chen ..... | H01R 4/4872 29/857 |
| 7,798,838 B2 * | 9/2010 | Grieff ..... | H01R 31/06 439/346 |
| 8,944,857 B2 * | 2/2015 | Mariano ..... | H01R 27/00 439/695 |

FOREIGN PATENT DOCUMENTS

| | | |
|---|---|---|
| JP | 4003545 B2 | 6/2002 |
| JP | 2002198146 A | 7/2002 |
| JP | 2004014404 A | 1/2004 |

(Continued)

OTHER PUBLICATIONS

European Office Action dated Jul. 20, 2020 issued in European Application No. 20151412.2.

*Primary Examiner* — Phuong K Dinh
(74) *Attorney, Agent, or Firm* — Holtz, Holtz & Volek PC

(57) ABSTRACT

A power plug conversion unit including a power plug conversion unit main body, a plurality of first plug pin insertion portions in which paired first plug pins of a power plug are respectively inserted, a plurality of conversion plug pins at least one of which moves in a direction orthogonal to a projecting direction, and an attaching and detaching mechanism configured to lock attachment and detachment of the first plug pins when the paired first plug pins are inserted into the first plug pin insertion portions, and release the lock of the first plug pins when at least one pin of the conversion plug pins is moved in the direction orthogonal to the projecting direction while the paired first plug pins are inserted in the first plug pin insertion portions.

11 Claims, 22 Drawing Sheets

(56) References Cited

FOREIGN PATENT DOCUMENTS

| | | | |
|---|---|---|---|
| JP | 2009104880 | A | 5/2009 |
| JP | 2009104881 | A | 5/2009 |
| JP | 2012048822 | A | 3/2012 |
| JP | 2015230786 | A | 12/2015 |

* cited by examiner

POWER PLUG CONVERSION UNIT

This application claims the benefit of Japanese Application No. 2018-171683 filed in Japan on Sep. 13, 2018, Japanese Application No. 2019-089065 filed in Japan on May 9, 2019, the entire contents of each of which are incorporated herein by their reference.

BACKGROUND OF THE INVENTION

1. Field of the Invention

The present invention relates to a power plug conversion unit that converts a power plug configured to supply electric power to an electrical product into a power plug adaptable to a wiring plug connector (outlet) suitable for each country.

2. Description of the Related Art

AC power outlets different in shape among different countries and districts have been conventionally used. From this situation, for example, in order to use an electric product adaptable to a domestic power plug in another country or the like, a power plug conversion unit is used which converts the domestic power plug into a power plug adaptable to the shape of an AC power outlet in the country or district where the electric product is used.

For this purpose, various types of power plug conversion units have been proposed and put into practical use, for example, by Japanese Patent Application Laid-Open Publication No. 2015-230786, etc.

In these types of power plug conversion units, it is necessary to ensure the electrical connection between the power plug of the electrical product and the power plug conversion unit from the viewpoint of safety and the like. For this purpose, there are international technical standards such as IEC 60950-1 (safety standard of information equipment) defined, for example, by International Electrotechnical Commission (IEC).

The above safety standard (IEC 60950-1) requires, for example, to provide a locking mechanism for securing a reliable connection state between the power plug of the electric product and the power plug conversion unit.

Therefore, various types of power plug conversion units each provided with a locking mechanism for securing the reliable connection state between a power plug and a power plug conversion unit have been conventionally proposed and put into practical use, for example, by Japanese Patent Application Laid-Open Publication No. 2002-198146, Japanese Patent Application Laid-Open Publication No. 2012-48822, Japanese Patent Application Laid-Open Publication No. 2009-104880, Japanese Patent Application Laid-Open Publication No. 2009-104881 and the like.

SUMMARY OF THE INVENTION

A power plug conversion unit according to an aspect of the present invention comprises: a power plug conversion unit main body; a plurality of first plug pin insertion portions which are provided on one end surface of the power plug conversion unit main body and in which paired first plug pins of a power plug are respectively inserted; a plurality of conversion plug pins which are arranged so as to protrude from another end surface of the power plug conversion unit main body, and at least one of which moves (in a direction orthogonal to a projecting direction); and an attaching and detaching mechanism configured to lock attachment and detachment of the first plug pins when the paired first plug pins are inserted into the first plug pin insertion portions, and release the lock of the first plug pins when at least one pin of the conversion plug pins is moved (in the direction orthogonal to the projecting direction) while the paired first plug pins are inserted in the first plug pin insertion portions.

The benefits of the present invention will become more apparent from the following detailed description.

DETAILED DESCRIPTION OF THE PREFERRED EMBODIMENT(S)

Figure 1:
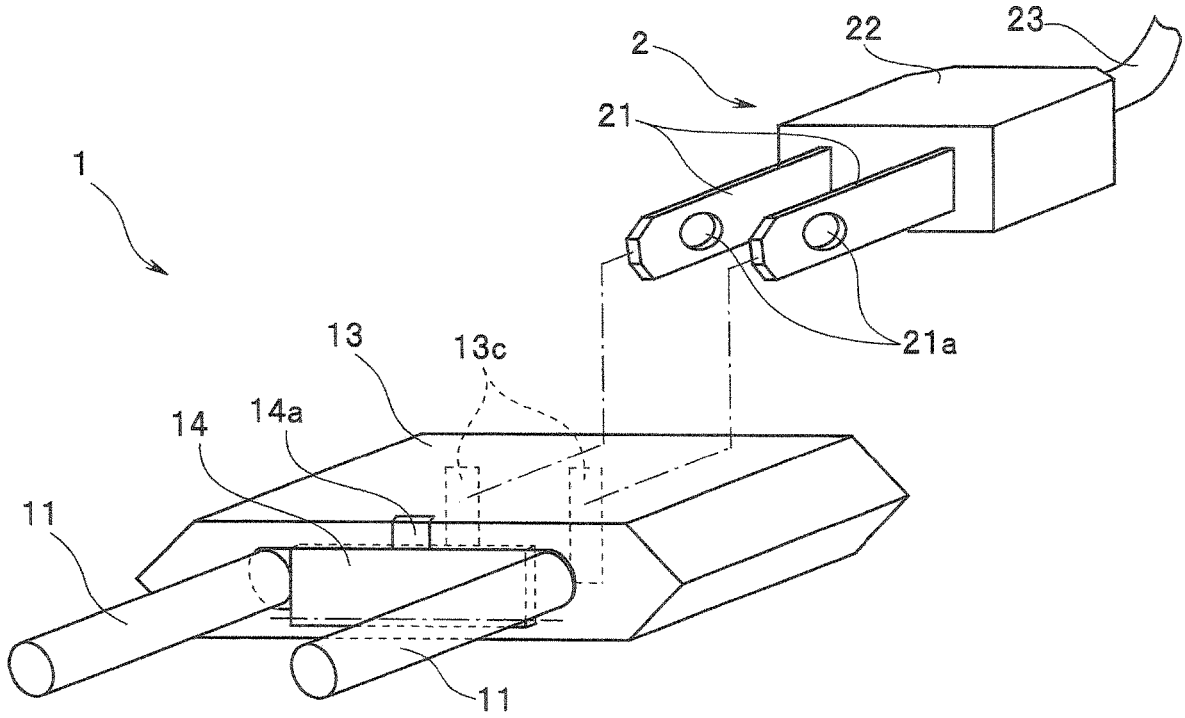
FIG. 1 is an external appearance perspective view of a power plug conversion unit according to an embodiment of the present invention (a safety cover closed state)

The present invention will be hereinafter described by illustrated embodiments. The drawings used in the following description are schematically shown, and in order to show each component in a size that enables the component to be recognized in the drawings, respective members may be shown so that the dimensional relationship, scales, etc., of the respective members are made different among respective components. Therefore, the present invention is not limited only to illustrated forms with respect to the number of the respective components, the shapes of the respective components, the ratio of the sizes of the respective components, the relative positional relationship of the respective components, etc., described in the respective drawings.

[First Embodiment] (FIGS. 1 to 12)

Figure 2:
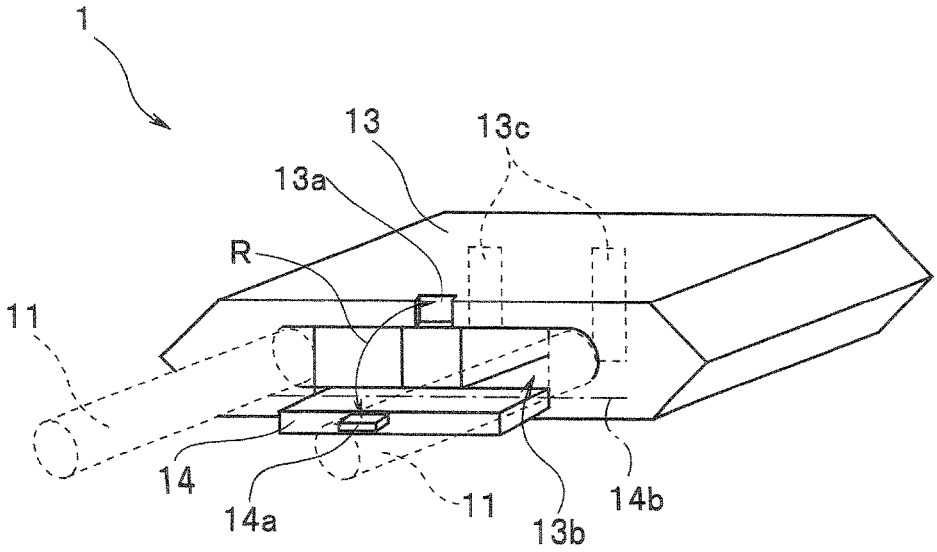
FIG. 2 is an external appearance perspective view of the power plug conversion unit according to the embodiment of the present invention (a safety cover opened state)

FIGS. 1 and 2 are external appearance perspective views of a power plug conversion unit according to an embodiment of the present invention, wherein FIG. 1 shows a closed state of a safety cover in the power plug conversion unit of the present embodiment, and FIG. 2 shows an opened state of the safety cover in the power plug conversion unit of the present embodiment. Note that FIG. 1 shows a power plug corresponding to the power plug conversion unit of the present embodiment together with the power plug conversion unit. In FIG. 2, in order to avoid complication of the drawing and make the opened state of the safety cover clear, some members in the power plug conversion unit are shown by dotted lines.

Figure 3:
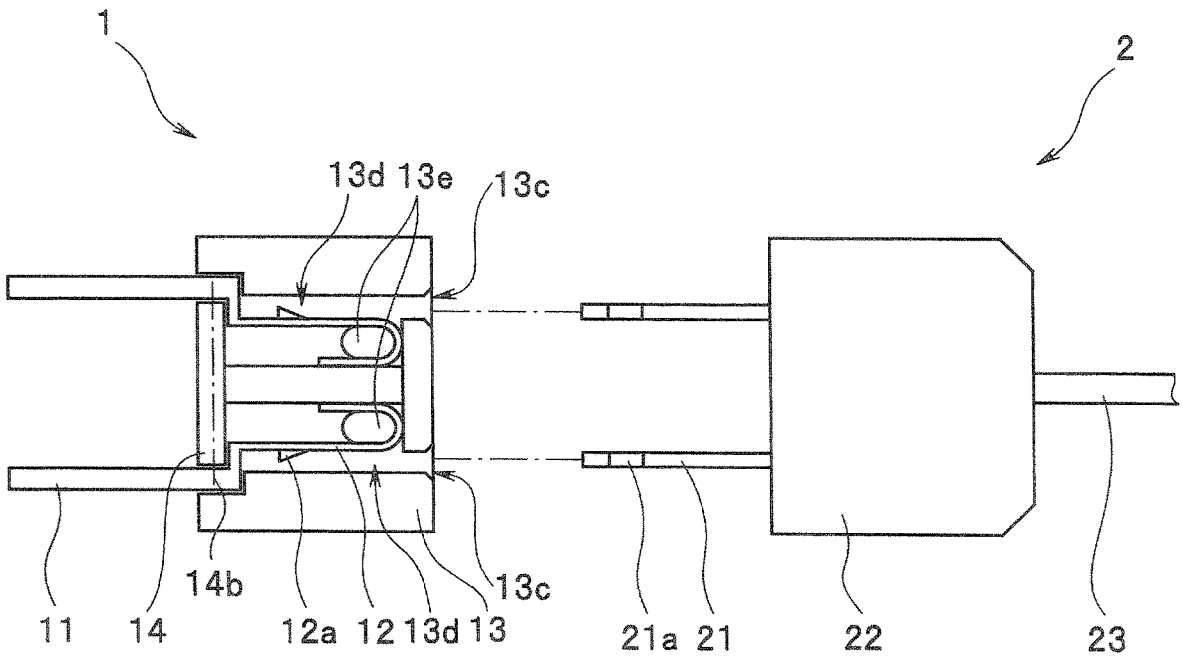
FIG. 3 is an internal configuration diagram showing an outline of an internal configuration of the power plug conversion unit according to the embodiment of the present invention (plan view; the safety cover closed state)
Figure 4:
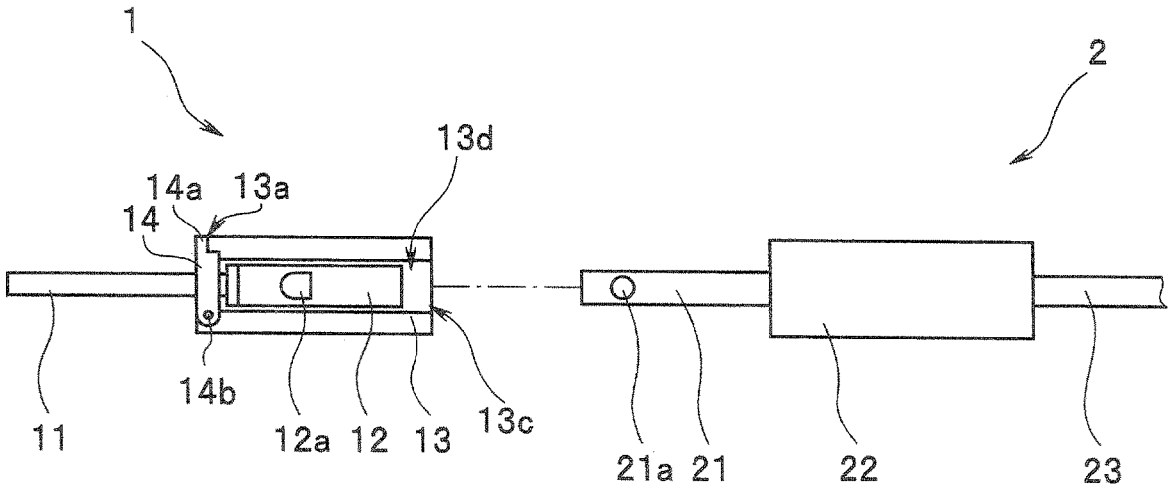
FIG. 4 is an internal configuration diagram showing an outline of the internal configuration of the power plug conversion unit according to the embodiment of the present invention (side view; the safety cover closed state)

FIGS. 3 and 4 are internal configuration diagrams schematically showing an internal configuration of the power plug conversion unit according to the embodiment of the present invention, wherein FIG. 3 is a plan view of the power plug conversion unit of the present embodiment when the power plug conversion unit is viewed from a top side, and FIG. 4 is a side view of the power plug conversion unit of the present embodiment when the power plug conversion unit is viewed from a side. Note that FIGS. 3 and 4 show the power plug corresponding to the power plug conversion unit of the present embodiment together with the power plug conversion unit as in the case of FIG. 1. Furthermore, FIGS. 3 and 4 show the closed state of the safety cover.

The power plug conversion unit exemplified in the present embodiment is a power plug conversion unit configured to convert a power plug of a type A into a power plug of a type C. In this example, particularly, a so-called straight type power plug conversion unit in which plug pins of the power plug conversion unit are formed to extend in the same direction as plug pins of the power plug is illustrated.

As shown in FIGS. 1, 3 and 4, the power plug conversion unit 1 of the present embodiment is configured to convert the power plug 2 of type A into the power plug of type C as described above.

Here, the power plug 2 is a general type power plug which is configured to include a pair of power plug blades 21 (which is a pair of first plug pins), a plug body 22 and a power cable 23.

The pair of power plug blades 21 projects from one end of the plug body 22, and the power cable 23 extends from another end of the plug body 22. In the plug body 22, each of the pair of power plug blades 21 and the power cable 23 are connected to each other in a predetermined form. Furthermore, each of the pair of power plug blades 21 is provided with a through-hole 21*a* (hereinafter simply referred to as a hole 21*a*) formed at a predetermined site close to a distal end of the power plug blade 21.

Note that it is assumed that a generally pervasive power plug is applied as the power plug 2. Accordingly, the description of a detailed configuration of the power plug 2 is omitted.

The power plug conversion unit 1 is configured to mainly include a pair of conversion plug blades 11 which is a pair of second plug pins, a pair of leaf spring contact pieces 12 which is a pair of plate-like spring members (not shown in FIGS. 1 and 2, and see FIGS. 3 and 4), a conversion unit body case 13 (a power plug conversion unit main body) and the like.

The conversion unit main body case (hereinafter simply referred to as a main body case) 13 is a housing having an internal space. The main body case 13 is configured to include a cover locking portion 13*a*, an opening 13*b*, a pair of first plug pin insertion portions 13*c*, a safety cover 14, a cover locked convex portion 14*a*, a hinge 14*b*, and the like.

A pair of first plug pin insertion portions 13*c* are provided to one end surface of the main body case 13. The pair of first plug pin insertion portions 13*c* are insertion holes into which the paired power plug blades 21 of the power plug 2 are respectively inserted.

Although details will be described later, internal spaces 13*d* in which the power plug blades 21 inserted from the first plug pin insertion portions 13*c* are arranged and also the paired leaf spring contact pieces 12 are respectively arranged in predetermined forms are formed in an internal region communicating with the pair of first plug pin insertion portions 13*c* inside the main body case 13 (see FIGS. 3 and 4).

The paired conversion plug blades 11 are arranged on another end surface opposite to the aforementioned one end surface in the main body case 13 so as to protrude from the other end surface. Furthermore, an opening 13*b* is formed in a region sandwiched by the paired conversion plug blades 11 on the other end surface. The safety cover 14 is arranged so as to cover the opening 13*b*.

As described above, the opening 13*b* is formed in the region sandwiched by the paired conversion plug blades 11. By providing the opening 13*b* in the aforementioned region, the paired conversion plug blades 11 are allowed to be displaced in a mutually approaching direction in which the paired conversion plug blades mutually approach each other (details will be described later).

The safety cover 14 is provided on the other end surface of the main body case 13 so as to move in a direction of an arrow R shown in FIG. 2 between a position where the safety cover 14 covers the opening 13*b* (a state of FIG. 1) and a position where the safety cover 14 opens the opening 13*b* (see FIG. 2). Therefore, the safety cover 14 is configured to be turnable around the hinge 14*b* with respect to a fixed portion (not shown) of the main body case 13.

The cover locking portion 13*a* configured to lock the cover locked convex portion 14*a* provided to the safety cover 14 is formed at a predetermined site of a peripheral edge of the opening 13*b* on the other end surface of the main body case 13.

Accordingly, when the safety cover 14 is set to a closed state shown in FIG. 1, the cover locked convex portion 14*a* of the safety cover 14 engages with the cover locking portion 13*a* of the main body case 13, whereby the closed state of the safety cover 14 is maintained.

When the safety cover 14 is in the closed state shown in FIG. 1, the safety cover 14 functions as a blade turning preventing member configured to prevent the paired conversion plug blades 11 from being displaced in the mutually approaching direction. On the other hand, when the safety cover 14 is in an opened state shown in FIG. 2, the safety cover 14 allows the paired conversion plug blades 11 to be displaced in the mutually approaching direction.

As described above, the paired conversion plug blades 11 are arranged so as to protrude outward from the opening 13*b* on the other end surface of the main body case 13. The paired conversion plug blades 11 are configured to be displaced in the mutually approaching direction along the opening 13*b*. Therefore, each of the paired conversion plug blades 11 is connected to one end portion of each of the paired leaf spring contact pieces 12.

Each of the paired leaf spring contact pieces 12 (see FIGS. 3 and 4) is arranged in each of the internal spaces 13*d* which communicates with each first plug pin insertion portion 13*c*. A fixed support portion 13*e* is formed in each of the internal spaces 13*d*. The other end portion of each of the paired leaf spring contact pieces 12 is supported in a cantilever style by the fixed support portion 13*e*.

Therefore, according to the aforementioned configuration, when the paired conversion plug blades 11 are displaced in the mutually approaching direction, for example, by receiving an operation force of user's fingers or the like, the operation force is transmitted from each of the paired conversion plug blades 11 to each of the leaf spring contact pieces 12. As a result, the paired leaf spring contact pieces 12 are configured to mutually sag with the respective fixed support portions 13*e* as fulcrums.

At that time, the respective internal spaces 13*d* of the main body case 13 further have regions where the paired power plug blades 21 of the power plug 2 are arranged in parallel to the paired leaf spring contact pieces 12. In other words, each of the paired power plug blades 21 inserted from each first plug pin insertion portion 13*c* into each internal space 13*d* is arranged in parallel to the paired leaf spring contact pieces 12.

Each of the paired leaf spring contact pieces 12 is provided with a lock pawl 12*a* which engages with the hole 21*a* of each of the paired power plug blades 21 when the paired power plug blades 21 of the power plug 2 are inserted into the internal spaces 13*d* from the first plug pin insertion portions 13*c*.

Each of the lock pawls 12*a* engages with the hole 21*a* provided in each of the paired power plug blades 21 when each of the paired power plug blades 21 is inserted into each of the first plug pin insertion portions 13*c*. The engagement of the lock pawls 12*a* with the holes 21*a* prevents the power plug blades 21 from being pulled out of the first plug pin insertion portions 13*c*. As a result, the movement of the power plug blades 21 in an inserting and pulling direction at predetermined positions in the first plug pin insertion portions 13*c* is locked.

As described above, the power plug conversion unit 1 according to the present embodiment is provided with an attaching and detaching mechanism configured to lock attachment and detachment of the power plug blades 21 when the power plug blades 21 are inserted into the first plug pin insertion portions 13*c* and release the lock of the power plug blades 21 when the paired conversion plug blades 11 are turned in a state where the power plug blades 21 are inserted in the first plug pin insertion portions 13*c*. Here, the attaching and detaching mechanism is configured by the lock pawls 12*a* of the leaf spring contact pieces 12 and the holes 21*a* of the power plug blades 21.

The operation of the power plug conversion unit 1 of the present embodiment configured as described above will be described below with reference to FIGS. 1 to 4 and FIGS. 5 to 12.

Figure 5:
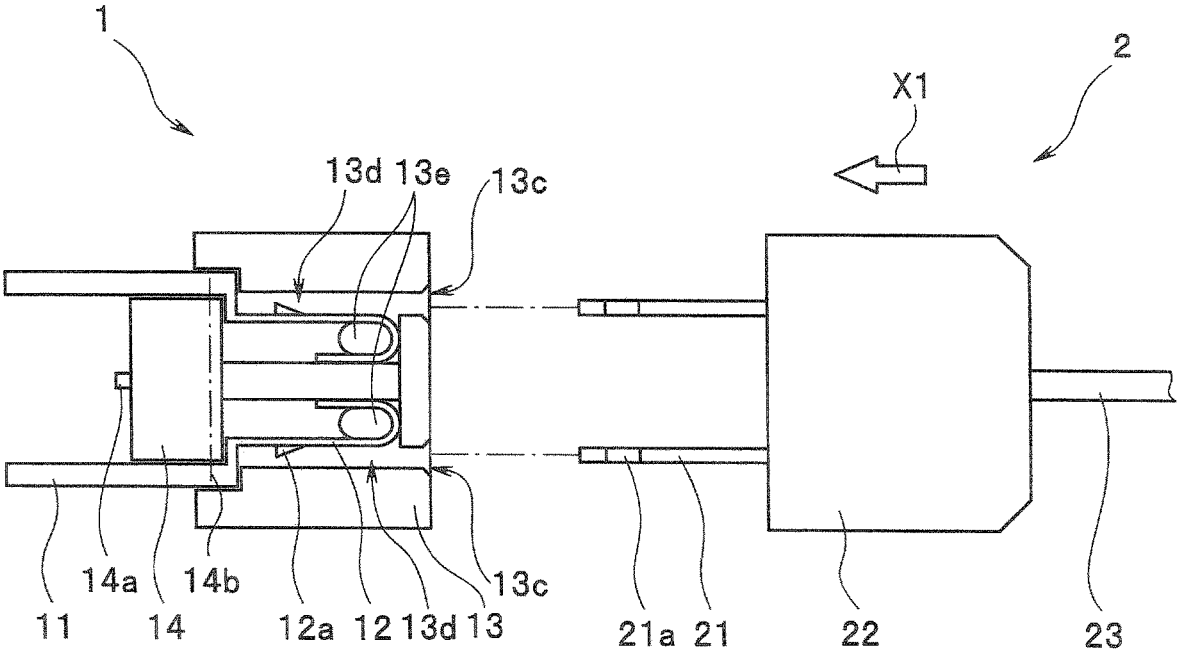
FIG. 5 is a plan view showing the internal configuration before a power plug is connected to the power plug conversion unit according to the embodiment of the present invention (the safety cover opened state)
Figure 6:
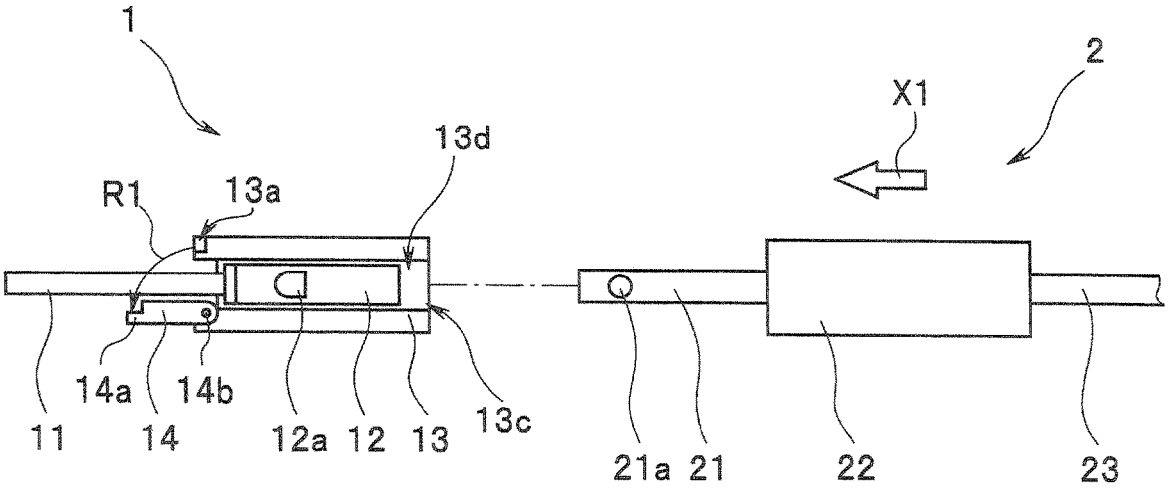
FIG. 6 is a side view of FIG. 5 (the safety cover opened state)

FIGS. 5 and 6 are diagrams showing a state before the power plug 2 is connected to the power plug conversion unit 1 of the present embodiment, wherein FIG. 5 is a plan view showing an internal configuration, and FIG. 6 is a side view showing the internal configuration. Here, FIGS. 5 and 6 show the opened state of the safety cover 14.

Figure 7:
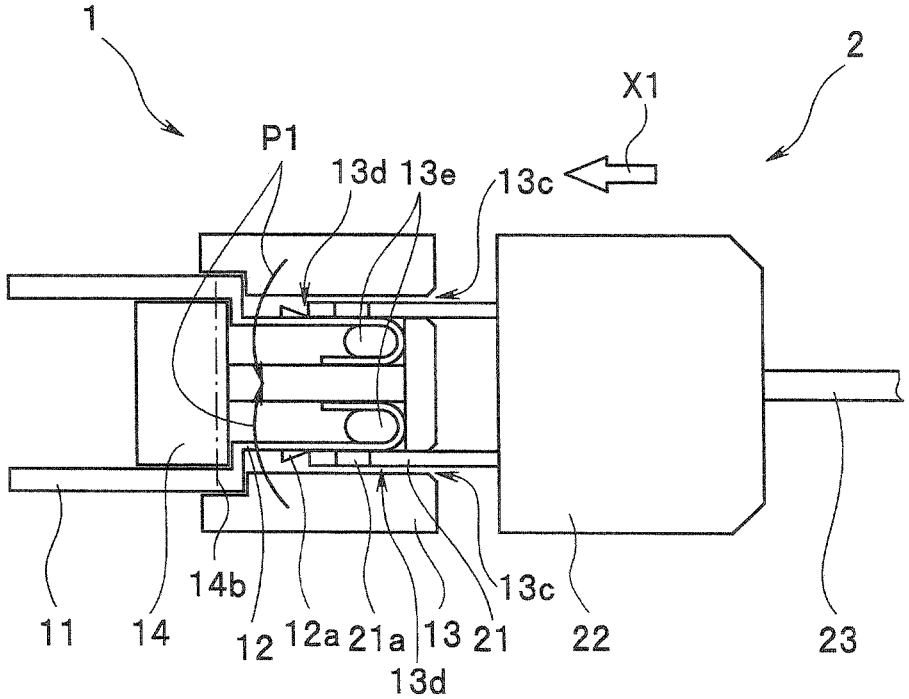
FIG. 7 is an operation diagram of the power plug conversion unit according to the embodiment of the present invention (a plan view showing the internal configuration in a state where parts of power plug blades are inserted into first plug pin insertion portions after the state of FIG. 5)

FIG. 7 is a plan view showing the internal configuration in a state where parts of the power plug blades 21 of the power plug 2 are inserted into the first plug pin insertion portions 13*c* of the power plug conversion unit 1 after the state of FIG. 5.

Figure 8:
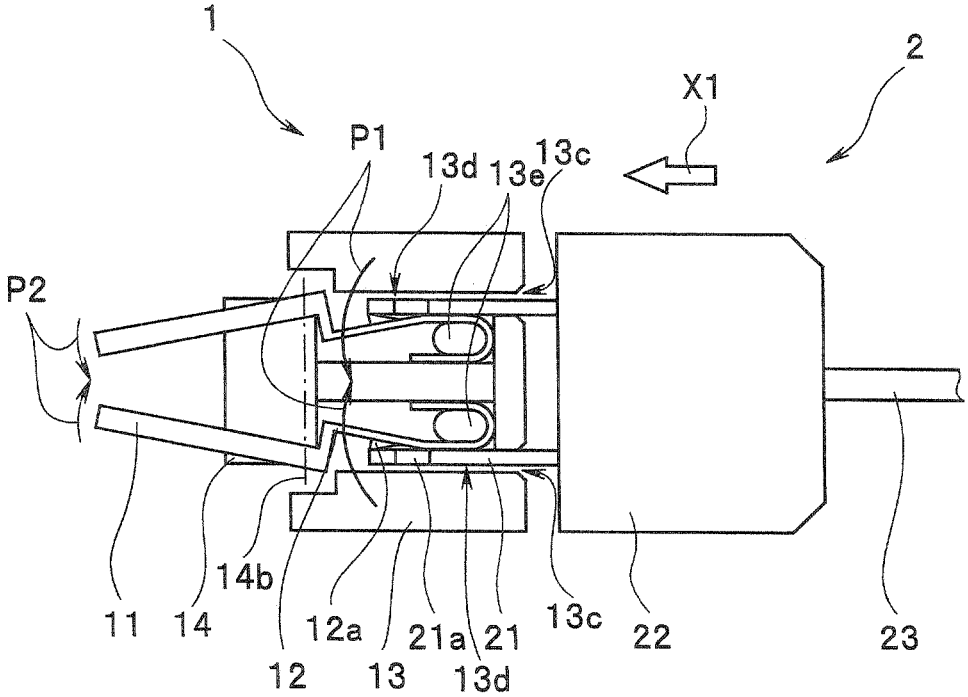
FIG. 8 is an operation diagram of the power plug conversion unit according to the embodiment of the present invention (a plan view showing the internal configuration in a state where leaf spring contact pieces are made to sag by the power plug blades after the state of FIG. 7)

FIG. 8 is a plan view showing the internal configuration in a state where the leaf spring contact pieces 12 are made to sag by the power plug blades 21 of the power plug 2 after the state of FIG. 7.

Figure 9:
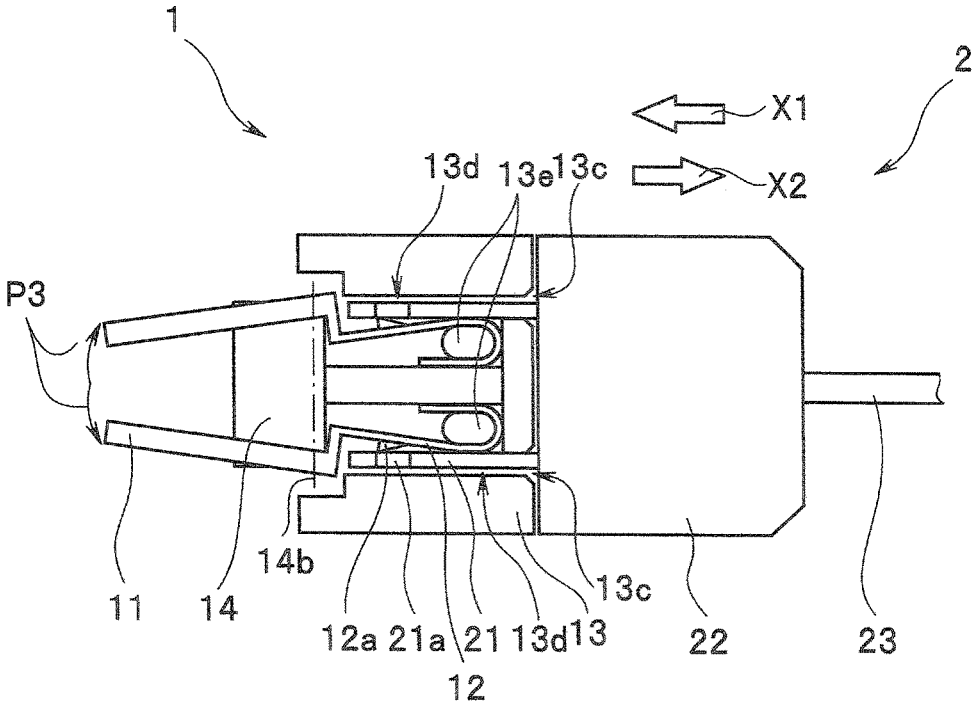
FIG. 9 is an operation diagram of the power plug conversion unit according to the embodiment of the present invention (a plan view showing the internal configuration in a state just before lock pawls engage with holes after the state of FIG. 8)

FIG. 9 is a plan view showing the internal configuration in a state just before the lock pawls 12*a* engage with the holes 21*a* after the state of FIG. 8.

Figure 10:
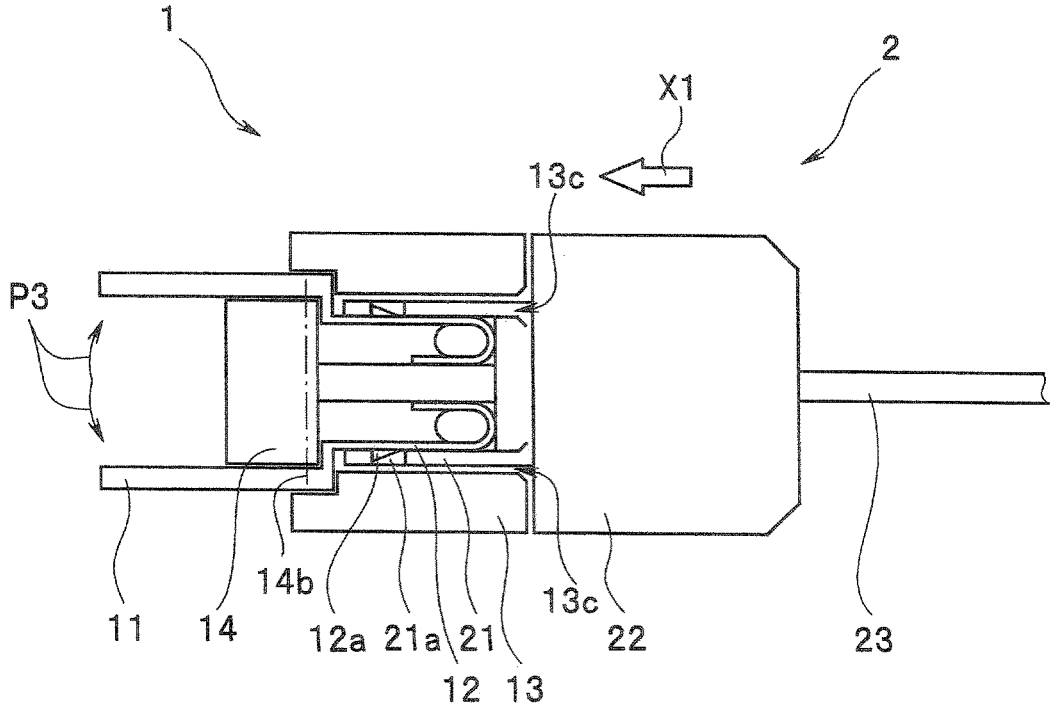
FIG. 10 is an operation diagram of the power plug conversion unit according to the embodiment of the present invention (a plan view showing the internal configuration in a state where the lock pawls engage with the holes and thus the leaf spring contact pieces are restored from the sagging state after the state of FIG. 9)

FIG. 10 is a plan view showing the internal configuration in a state where the lock pawls 12*a* engage with the holes 21*a* after the state of FIG. 9, so that the leaf spring contact pieces 12 are restored from the sagging state.

Figure 11:
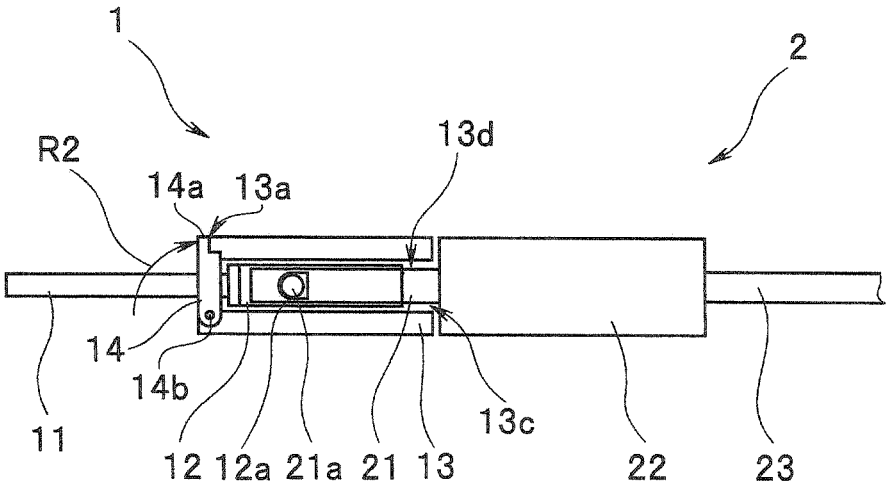
FIG. 11 is an operation diagram of the power plug conversion unit according to the embodiment of the present invention (a side view showing the internal configuration in a connection state between the power plug conversion unit and the power plug)
Figure 12:
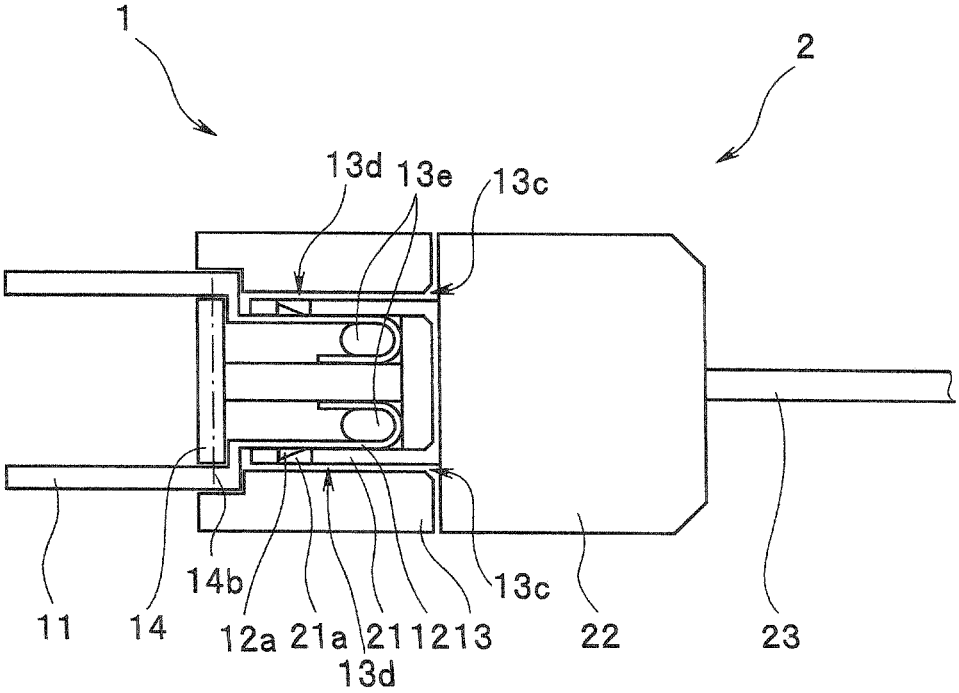
FIG. 12 is an operation diagram of the power plug conversion unit according to the embodiment of the present invention (a plan view showing the internal configuration in the connection state between the power plug conversion unit and the power plug)

FIGS. 11 and 12 are diagrams showing a state where the power plug 2 is connected to the power plug conversion unit 1, wherein FIG. 11 is a plan view showing the internal configuration, and FIG. 12 is a side view showing the internal configuration. Here, FIG. 11 and FIG. 12 show the closed state of the safety cover 14.

In the above FIGS. 5 to 12, in order to clarify the internal configuration of the power plug conversion unit 1, a part of the main body case 13 is omitted from the illustration.

In order to connect the power plug 2 to the power plug conversion unit 1 of the present embodiment, first, the safety cover 14 of the power plug conversion unit 1 is set from the closed state shown in FIGS. 1, 3 and 4 to the opened state shown in FIGS. 2, 5 and 6.

Therefore, in order to displace the safety cover 14 to the opened state, a user performs an operation of turning the cover locked convex portion 14*a* of the safety cover 14 in a direction of an arrow R1 shown in FIG. 6 by using fingers or the like. As a result, the cover locked convex portion 14*a* of the safety cover 14 is released from the cover locking portion 13*a* of the main body case 13. Then, the safety cover 14 is turned around the hinge 14*b*, and displaced to the opened state of FIGS. 5 and 6.

In this state, the user moves the power plug 2 in a direction of an arrow X1 in FIGS. 5 and 6 (hereinafter referred to as an "insertion direction X1"). At this time, each of the paired power plug blades 21 of the power plug 2 is moved so as to be inserted into each first plug pin insertion portion 13*c* of the power plug conversion unit 1.

Then, when each of the paired power plug blades 21 of the power plug 2 is inserted from each first plug pin insertion portion 13*c* of the power plug conversion unit 1, each power plug blade 21 is subsequently moved along the internal space 13*d* by merely pushing the power plug 2 along the insertion direction X1.

Thereafter, as shown in FIG. 7, a distal end site of each power plug blade 21 abuts against one end portion of the lock pawl 12*a* of each leaf spring contact piece 12. Here, when the power plug 2 is further pushed along the insertion direction X1, the distal end site of each power plug blade 21 presses the lock pawl 12*a*. Following this press, the paired leaf spring contact pieces 12 are made to sag in a direction of an arrow P1 in FIGS. 7 and 8 with each fixed support portion 13*e* as a support shaft. In conjunction with this sagging, the paired conversion plug blades 11 are turned in a direction of an arrow P2 in FIG. 8, that is, in the mutually approaching direction with the fixed support portions 13*e* as rotation centers. At this time, since the safety cover 14 is in the opened state, the safety cover 14 does not prevent the paired conversion plug blades 11 from turning in the mutually approaching direction.

When the power plug blades 21 press the lock pawls 12*a* at the distal end sites of the power plug blades 21 and continue to move in the insertion direction X1 while causing the paired leaf spring contact pieces 12 to sag, eventually, the lock pawls 12*a* are allowed to engage with the holes 21*a* as shown in FIG. 9. Just after the state of FIG. 9, the lock pawls 12*a* engage with the holes 21*a* as shown in FIG. 10. As a result, the sagging of the paired leaf spring contact pieces 12 are released, and the paired leaf spring contact pieces 12 are restored to an original state as shown in FIG. 10 by their own biasing force. At the same time, the paired conversion plug blades 11 are also displaced in a direction of an arrow P3 in FIG. 10 and returns to an original position.

In the state of FIG. 10, the user turns the safety cover 14 in a direction of an arrow R2 shown in FIG. 11 to engage the cover locked convex portion 14*a* with the cover locking portion 13*a*. As a result, the safety cover 14 is set to the closed state as shown in FIGS. 11 and 12.

In this state, the lock pawls 12*a* engage with the holes 21*a*, whereby the power plug 2 is set to a locked state where the power plug 2 cannot be pulled out from the power plug conversion unit 1. Furthermore, at this time, the safety cover 14 prevents the paired conversion plug blades 11 from turning in the mutually approaching direction. Accordingly, the power plug 2 is not easily pulled out from the power plug conversion unit 1.

In this state, the paired conversion plug blades 11 of the power plug conversion unit 1 are inserted into a corresponding AC power supply outlet (not shown) to start use of a target electric product.

Under this state, it is impossible to displace the safety cover 14 to the opened state in the power plug conversion unit 1 of the present embodiment. At the same time, it is impossible to turn the paired conversion plug blades 11 in the mutually approaching direction. Accordingly, when the power plug conversion unit 1 is used, the power plug 2 inserted in the power plug conversion unit 1 is set to a state where the power plug 2 cannot be easily pulled out.

On the other hand, an operation at the time when the power plug 2 is pulled out from the power plug conversion unit 1 is as follows. First, the power plug conversion unit 1 in use is pulled out from the AC power supply outlet (not shown) in a state where the power plug conversion unit 1 and the power plug 2 are connected to each other.

In the state shown in FIGS. 11 and 12, first, the safety cover 14 is displaced to the opened state to set the safety cover 14 to the state shown in FIG. 10. In this state, the paired conversion plug blades 11 are turned in the mutually approaching direction. As a result, as shown in FIG. 9, the paired leaf spring contact pieces 12 mutually sag in conjunction with the turning of each of the paired conversion plug blades 11, whereby the engagement between the lock pawls 12*a* and the holes 21*a* is released, so that the lock of the power plug blades 21 is released.

In this state, the power plug 2 is moved in a pull-out direction (a direction of an arrow X2 direction which is an opposite direction to the direction of the arrow X1 in FIG.

9). As a result, the power plug 2 is pulled out from the power plug conversion unit 1, and set to a state shown in FIGS. 5 and 6.

As described above, in the power plug conversion unit 1 of the present embodiment, when the paired power plug blades 21 are inserted into the first plug pin insertion portions 13*c*, the paired leaf spring contact pieces 12 are made to sag due to press of the power plug blades 21 against the lock pawls 12*a*, and then the lock pawls 12*a* engage with the holes 21*a* provided in the power plug blades 21, whereby pull-out of the power plug blades 21 is prevented and thus locked.

When the paired conversion plug blades 11 are turned in the mutually approaching direction in a state where the safety cover 14 is set to the opened state, the paired leaf spring contact pieces 12 sag in conjunction with the turning of each of the paired conversion plug blades 11, so that the engagement between the lock pawls 12*a* and the holes 21*a* is released. As a result, the lock of the power plug blades 21 is released.

As described above, according to the embodiment, when the power plug blades 21 of the power plug 2 are inserted into the first plug pin insertion portions 13*c* of the power plug conversion unit 1, the lock pawls 12*a* of the leaf spring contact pieces 12 engage with the holes 21*a* of the power plug blades 21 of the power plug 2, whereby it is possible to easily lock the connection between the power plug conversion unit 1 and the power plug 2.

On the other hand, when the paired conversion plug blades 11 of the power plug conversion unit 1 are turned in the mutually approaching direction in a state where the power plug conversion unit 1 and the power plug 2 are connected to each other, an engagement state between the lock pawls 12*a* and the holes 21*a* can be easily released.

In this case, when the safety cover 14 is closed in a state where the power plug conversion unit 1 and the power plug 2 are connected to each other and the lock pawls 12*a* engage with the holes 21*a*, it is possible to prevent a turning operation of the paired conversion plug blades 11 in the mutually approaching direction, that is, an unlocking operation.

Accordingly, such a configuration makes it impossible to perform the turning operation (the unlocking operation) of the paired conversion plug blades 11 of the power plug conversion unit 1 in the mutually approaching direction when the power plug conversion unit 1 of the present embodiment is set to a usage state where the corresponding power plug 2 is connected to the power plug conversion unit 1 and the power plug conversion unit 1 is inserted in an AC power outlet (not shown).

In this usage state, the lock pawls 12*a* engage with the holes 21*a*, so that the power plug 2 is securely connected to the power plug conversion unit 1 and thus cannot be easily pulled out.

In other words, even during the pull-out operation of removing the power plug conversion unit 1 from a state where the power plug conversion unit 1 is inserted in the AC power outlet (not shown) while the power plug conversion unit 1 and the power plug 2 are connected to each other, the connection between the power plug conversion unit 1 and the power plug 2 is reliably maintained.

Therefore, when the power plug conversion unit 1 of the present embodiment is in use, it is possible to maintain a reliable connection state between the power plug conversion unit 1 and the power plug 2 at any time and prevent pull-out of the power plug 2.

The power plug conversion unit 1 of the present embodiment can ensure reliable connection with the corresponding power plug 2 with a simpler configuration. At the same time, a mechanism that can be easily attached and detached as needed can be realized with the simple configuration.

[First Modification] (not Shown)

Note that in the embodiment described above, a specific configuration example in a case where the power plug 2 of type A is converted to a power plug of type C is illustrated and described, but the present invention is not limited to such a form.

For example, in the power plug conversion unit 1 according to the aforementioned embodiment, the shape of the paired conversion plug blades 11 is defined as the type C. It is possible to adapt to various types of power plugs only by changing the paired conversion plug blades 11 of type C to plug blades of other types (for example, B, B-3, BF, O, O-2, SE, etc.).

Note that in this case, there are three plug blades of two plug blades and one ground blade in the types B-3, BF, O-2, etc., for example. In this case, a power plug conversion unit of a type having a ground blade may be formed by changing the shape of the main body case 13 and performing adaptation appropriately.

Therefore, it is unnecessary to make specifications of an electric product itself (the specifications on a power plug side) different among destination countries or districts, and it is easily possible to realize commonality of the specifications of electric products by attaching only one power plug conversion unit adaptable to each country or district.

Figure 13:
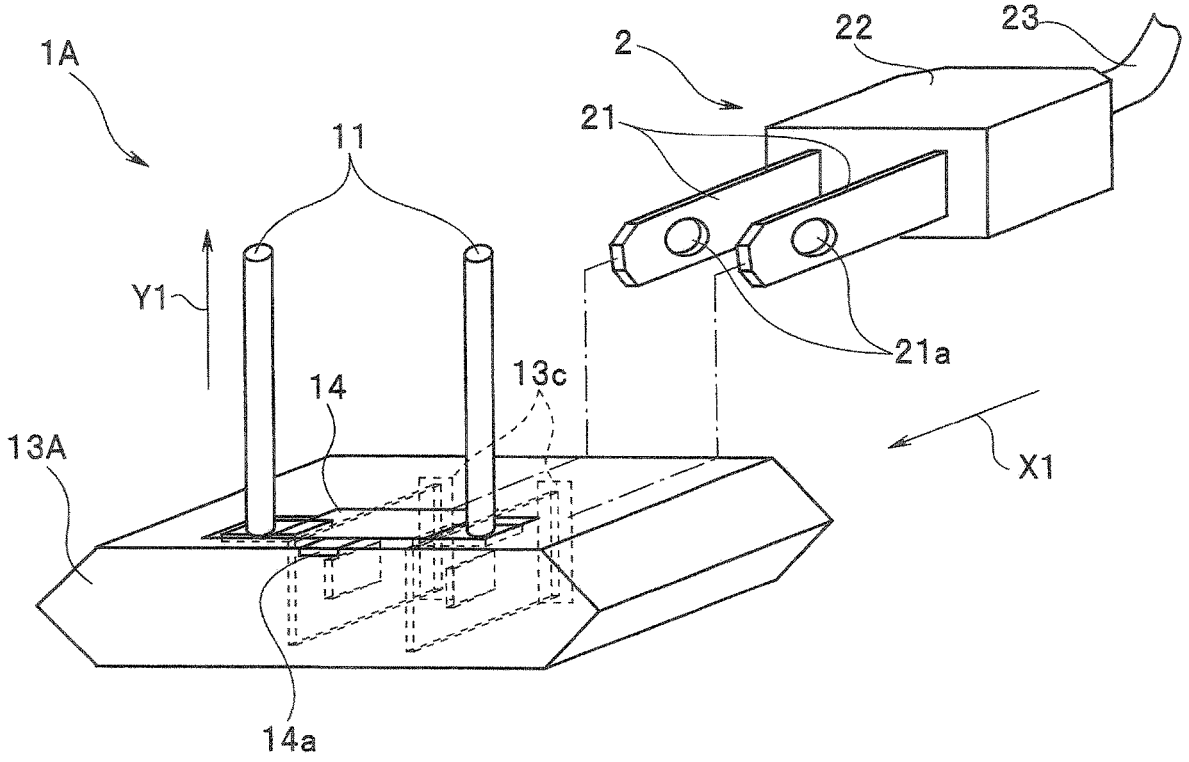
FIG. 13 is an external appearance perspective view of a second modification (elbow type) of the power plug conversion unit according to the embodiment of the present invention.

[Second Modification] (FIG. 13)

A so-called straight type power plug conversion unit having a form in which the paired conversion plug blades 11 of the power plug conversion unit 1 and the power plug blades 21 of the power plug 2 are formed to extend in a same direction is exemplified in the aforementioned embodiment. However, the power plug conversion unit to which the configuration of the present invention can be applied is not limited to such a form.

For example, the power plug conversion unit may be configured as a so-called elbow-type power plug conversion unit in which the paired conversion plug blades of the power plug conversion unit extend in a direction substantially orthogonal to the insertion direction of the power plug blades of the power plug. FIG. 13 is an external appearance perspective view showing a modification (a second modification of the present embodiment) in the case where the power plug conversion unit is configured as an elbow type.

As shown in FIG. 13, the power plug conversion unit 1A is provided so that the paired conversion plug blades 11 extend from one surface (top surface) of a main body case 13A in a direction (an arrow Y1 of FIG. 13) substantially orthogonal to an insertion direction (an arrow X1 of FIG. 13) of the power plug blades 21 of the corresponding power plug 2.

The main body case 13A is provided with a safety cover 14 in a region between the paired conversion plug blades 11. The safety cover 14 is a cover member configured to open and close an opening (not shown) formed in the top surface of the main body case 13A. Other configuration is similar to the configuration of the aforementioned embodiment.

Note that a power plug of the same type (type A) as the aforementioned embodiment is shown as the corresponding power plug 2 in FIG. 13 showing the present modification.

As described above, in the aforementioned embodiment and respective modifications, a power plug to be provided at a terminal of a power cable extending from an electric product is exemplified as a form on a power plug side which is adapted to the power plug conversion unit. However, the form of the power plug adaptable to the power plug conversion unit to which the configuration of the present invention can be applied is not limited to the above form.

Figure 14:
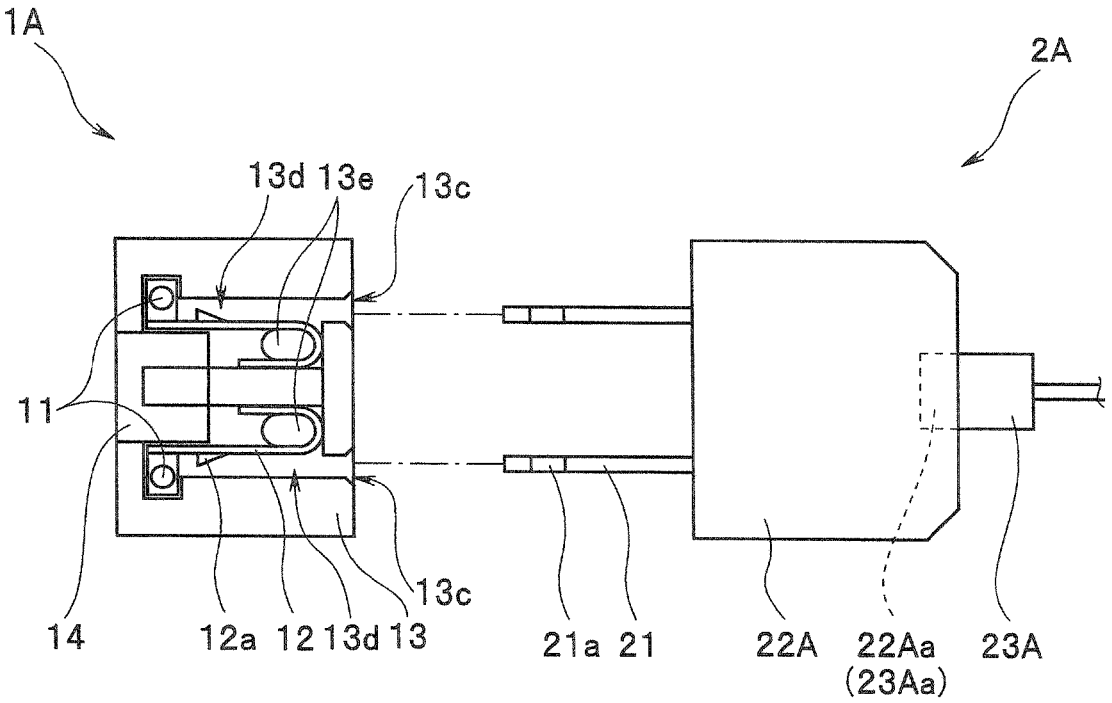
FIG. 14 is a plan view showing a case where the power plug conversion unit of FIG. 13 is used while connected to an AC adapter with a power plug.
Figure 15:
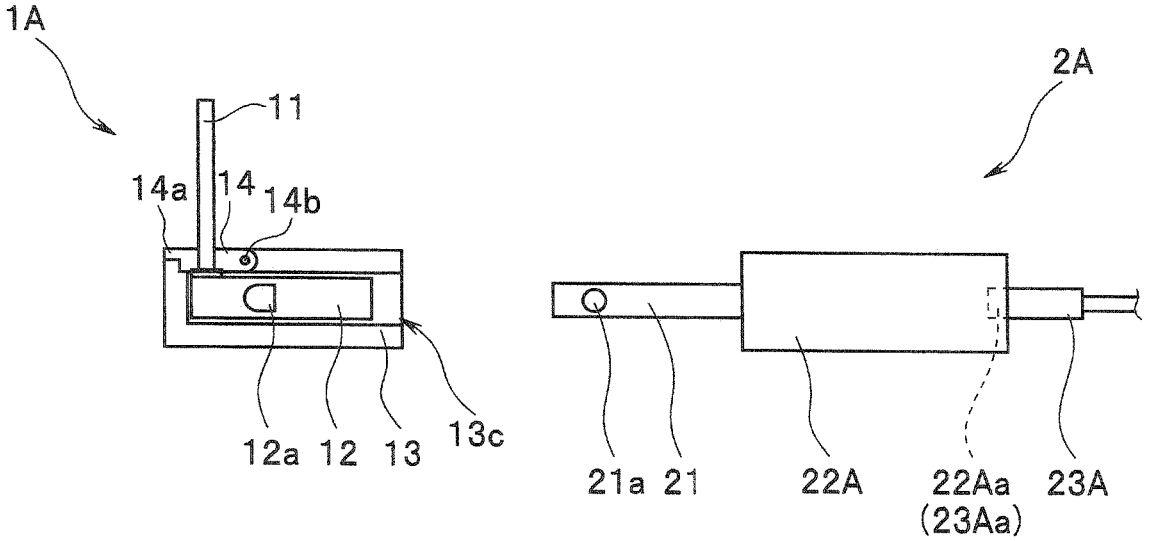
FIG. 15 is a side view of FIG. 14.

[Application Example of Second Modification] (FIGS. 14 and 15)

For example, the power plug conversion unit of the configuration of the present invention can be likewise used for an AC adapter with a power plug. FIGS. 14 and 15 are diagrams exemplifying a case where the power plug conversion unit of the aforementioned embodiment or each of the aforementioned modifications is used while connected to an AC adapter with a power plug, wherein FIG. 14 is a plan view showing an internal configuration and FIG. 15 is a side view showing the internal configuration.

The power plug conversion unit 1A shown in FIGS. 14 and 15 is identical to the power plug conversion unit shown in the second modification (see FIG. 13). In FIGS. 14 and 15, the power plug conversion unit 1A is configured so that an AC adapter 2A with a power plug is connected to the power plug conversion unit 1A.

Here, the AC adapter 2A with the power plug is configured to include a plug body case 22A and a pair of power plug blades 21. For example, a terminal portion 22Aa for connecting a connector portion 23Aa of a USB cable 23A is provided to one end surface of the plug body case 22A.

The power plug conversion unit 1A to which the configuration of the present invention is applied is applicable to the AC adapter 2A with the power plug having such a configuration in the same manner. An operation and an effect in that case are also similar to the operation and the effect of the aforementioned embodiment.

[Third Modification] (not Shown)

In the embodiment and the respective modifications described above, a configuration member that appropriately prevents or permits the turning operation of paired second plug pins (the paired conversion plug blades 11) of the power plug conversion unit in the mutually approaching direction at a predetermined time is configured by providing the safety cover 14 in the region between the paired conversion plug blades 11 on one surface of the main body case. However, the configuration member configured to appropriately prevent or permit the turning operation of the conversion plug blades 11 is not limited to the above form.

For example, similar operation and effect can be obtained by adopting the following configuration member instead of the safety cover 14 described above.

In other words, the configuration member may be configured by providing the main body case with an elastic member that is formed of a raw material such as rubber material and has elasticity having a property that the elastic member is compressed when pressurized and the shape of the elastic member is restored when the pressure is released is provided to an opening portion of the region sandwiched between the paired second plug pins (the paired conversion plug blades 11).

When this type of elastic member is adopted, execution of the turning operation of the paired conversion plug blades 11 in the mutually approaching direction causes the elastic member to be compressed, so that the paired leaf spring contact pieces 12 are allowed to sag. Furthermore, when the turning operation in the mutually approaching direction is not executed on the paired conversion plug blades 11, the paired conversion plug blades 11 are retained at a predetermined position, and can be prevented from turning in the mutually approaching direction.

When the power plug blades 21 of the power plug 2 are inserted into the first plug pin insertion portions 13*c* of the power plug conversion unit 1 to cause the lock pawls 12*a* to engage with the holes 21*a*, by pressing the power plug 2 into the first plug pin insertion portions 13*c* by a predetermined amount of force or more, the distal ends of the power plug blades 21 press the lock pawls 12*a*, so that the leaf spring contact pieces 12 can be caused to sag. As described above, when the lock pawls 12*a* are pressed and the paired leaf spring contact pieces 12 are caused to sag, the corresponding paired conversion plug blades 11 compress the elastic member. As a result, in a process of connecting the power plug 2 and the power plug conversion unit 1, the lock pawl 12*a* and the hole 21*a* engage with each other, and the locked state of both the lock pawl 12 and the hole 21*a* can be caused to appear.

Accordingly, according to such a configuration, it is possible to omit the operation required when the safety cover 14 is used (that is, the opening and closing operation of the safety cover 14), so that a simpler attaching and detaching operation can be realized.

Figure 16:
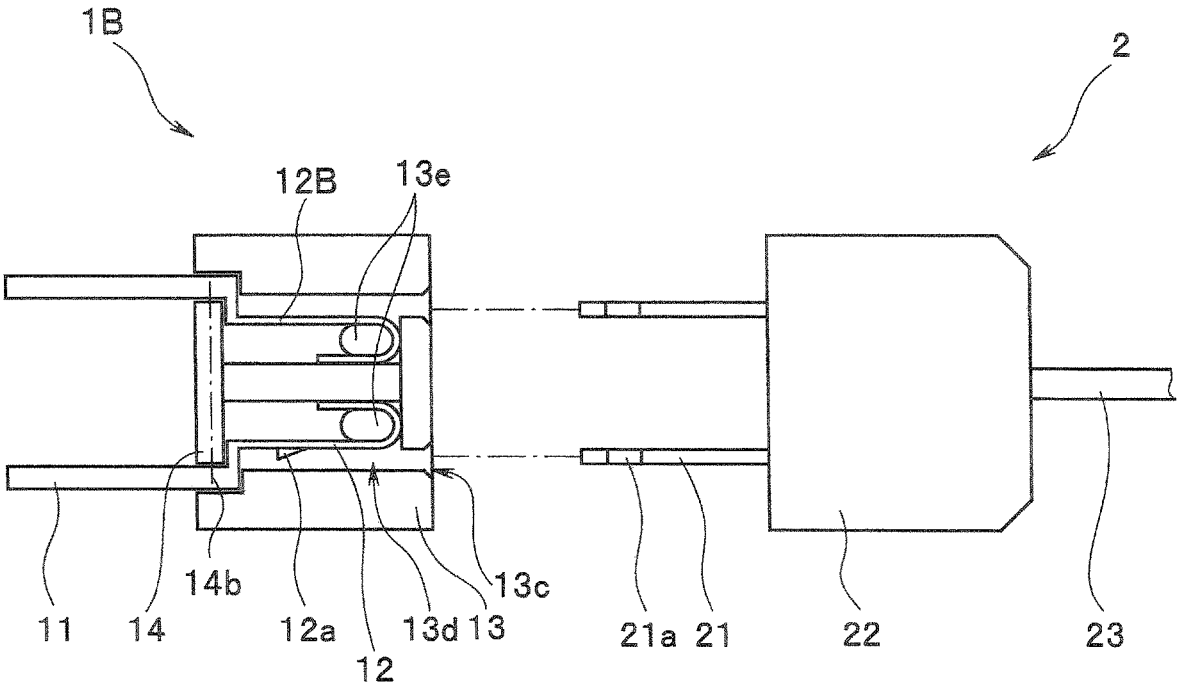
FIG. 16 is a plan view showing a fourth modification of the power plug conversion unit according to the embodiment of the present invention (a non-connection state)
Figure 17:
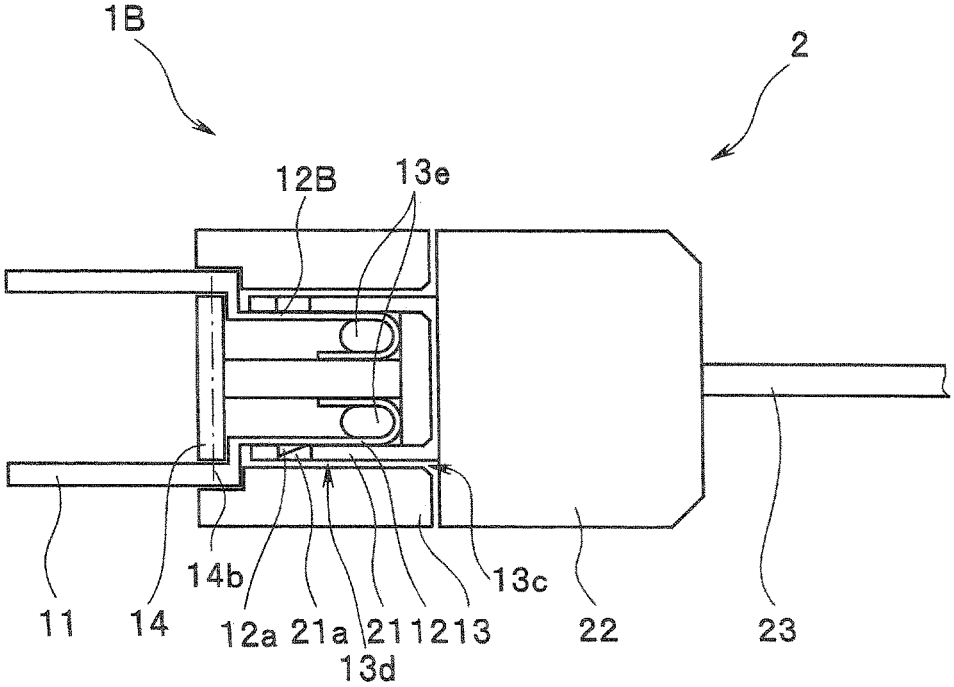
FIG. 17 is a plan view showing the fourth modification of the power plug conversion unit according to the embodiment of the present invention (a connection state)

[Fourth Modification] (FIGS. 16 and 17)

The embodiment and the respective modifications described above are configured so that the engagement between the lock pawls 12*a* and the holes 21*a* is released by performing the turning operation of both the paired second plug pins (the paired conversion plug blades 11) of the power plug conversion unit in the mutually approaching direction. However, the configuration that releases the locked state in the attaching and detaching mechanism is not limited to the above form.

For example, the lock pawl may be provided to only one (one side) of the paired second plug pins (the paired conversion plug blades 11) of the power plug conversion unit, and the release of the locked state may be allowed by performing the turning operation on only one of the conversion plug blades to which the lock pawl is provided. FIGS. 16 and 17 are diagrams showing the fourth modification of the embodiment of the present invention, wherein FIG. 16 shows a non-connection state between the power plug conversion unit and the power plug, and FIG. 17 shows a connection state between the power plug conversion unit and the power plug.

As shown in FIG. 16, paired leaf spring contact pieces in a power plug conversion unit 1B of the present modification are configured to include, as a pair, a leaf spring contact piece 12 provided with a lock pawl 12*a* (a form similar to the forms of the embodiment and the respective modifications described above), and a leaf spring contact piece 12B having no lock pawl. Other configuration is similar to the configuration of the embodiment and the respective modifications described above.

Even in such a configuration, when the paired power plug blades 21 are inserted into the respective first plug pin insertion portions 13*c*, the lock pawl 12*a* of one leaf spring contact piece 12 of the paired leaf spring contact pieces engages with the hole 21*a* of one of the power plug blades 21, thereby locking the attachment and detachment of the power plug blade 21.

Furthermore, when one conversion plug blade 11 of the paired conversion plug blades 11 is turned, thereby causing one leaf spring contact piece 12 to sag after the safety cover 14 is set to the opened state while the power plug blades 21 are inserted in the respective first plug pin insertion portions 13*c*, the engagement between the lock pawl 12*a* and the hole 21*a* is released, whereby the locked state of the power plug blade 21 is released.

Accordingly, in the configuration of the present modification, it is also possible to obtain an operation and an effect similar to the operation and the effect of the embodiment and the respective modifications described above.

Note that the configuration of the fourth modification is configured so that the engagement between the lock pawl 12*a* and the hole 21*a* is released by turning one conversion plug blade 11 (the conversion plug blade 11 to which the leaf spring contact piece 12 provided with the lock pawl 12*a* is connected) of the paired conversion plug blades 11.

In this case, in the configuration of the fourth modification, which one of the paired conversion plug blades 11 should be operated depends only on the difference in the internal configuration, and thus it is impossible for an operator to know which one of the conversion plug blade 11 to be operated by merely seeing the external appearance. Accordingly, it is necessary to take measures of performing marking or the like on the conversion plug blade 11 to which the leaf spring contact piece 12 provided with the lock pawl 12*a* is connected out of the paired conversion plug blades 11, that is, the conversion plug blade 11 to be turned for unlocking.

However, in the case of the configuration of the fourth modification, it is natural that an actual operation is an operation of turning both the paired conversion plug blades 11 in the mutually approaching direction as in the case of the embodiment and the respective modifications described above.

In consideration of the foregoing matters, even when the conversion plug blade 11 to be operated is not subjected to the marking or the like, the conversion plug blade 11 to which the leaf spring contact piece 12 provided with the lock pawl 12*a* is connected can be turned only by turning both the paired conversion plug blades 11 in the mutually approaching direction. Accordingly, the engagement between the lock pawl 12*a* and the hole 21*a* can be released by a simple operation without paying attention to the conversion plug blade 11 to be turned.

Substantially the same effect of the embodiment and the respective modifications described above can also be obtained by the fourth modification.

[Fifth Embodiment] (FIGS. 18 to 21)

In the embodiment and the respective modifications described above, a configuration of an unlocking mechanism configured to perform a predetermined operation on the paired conversion plug blades to release the engagement state between the lock pawl and the hole is shown. Therefore, a configuration example when a power plug of type A is converted to a power plug of type C is shown as a specific configuration example. An essential configuration of the present invention is not limited to the illustrated example, and can be configured even when a power plug of type A is converted to a power plug of another type.

In each modifications shown below is shown an example of a power plug conversion unit configured to convert a power plug of type A to a power plug having a form like type BF (type G), type B-3, D, O-2, or the like, that is, a form having totally three blades (pins) of two plug blades and one ground blade.

First, a fifth modification of the power plug conversion unit according to the embodiment of the present invention will be described below with reference to FIGS. 18 to 20.

Figure 18:
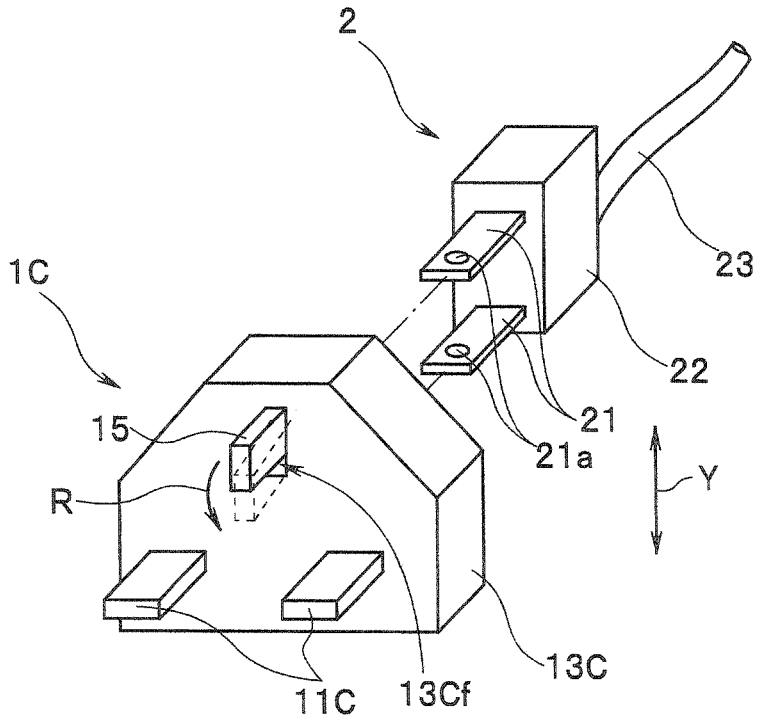
FIG. 18 is an external appearance perspective view of a fifth modification of the power plug conversion unit according to the embodiment of the present invention.
Figure 19:
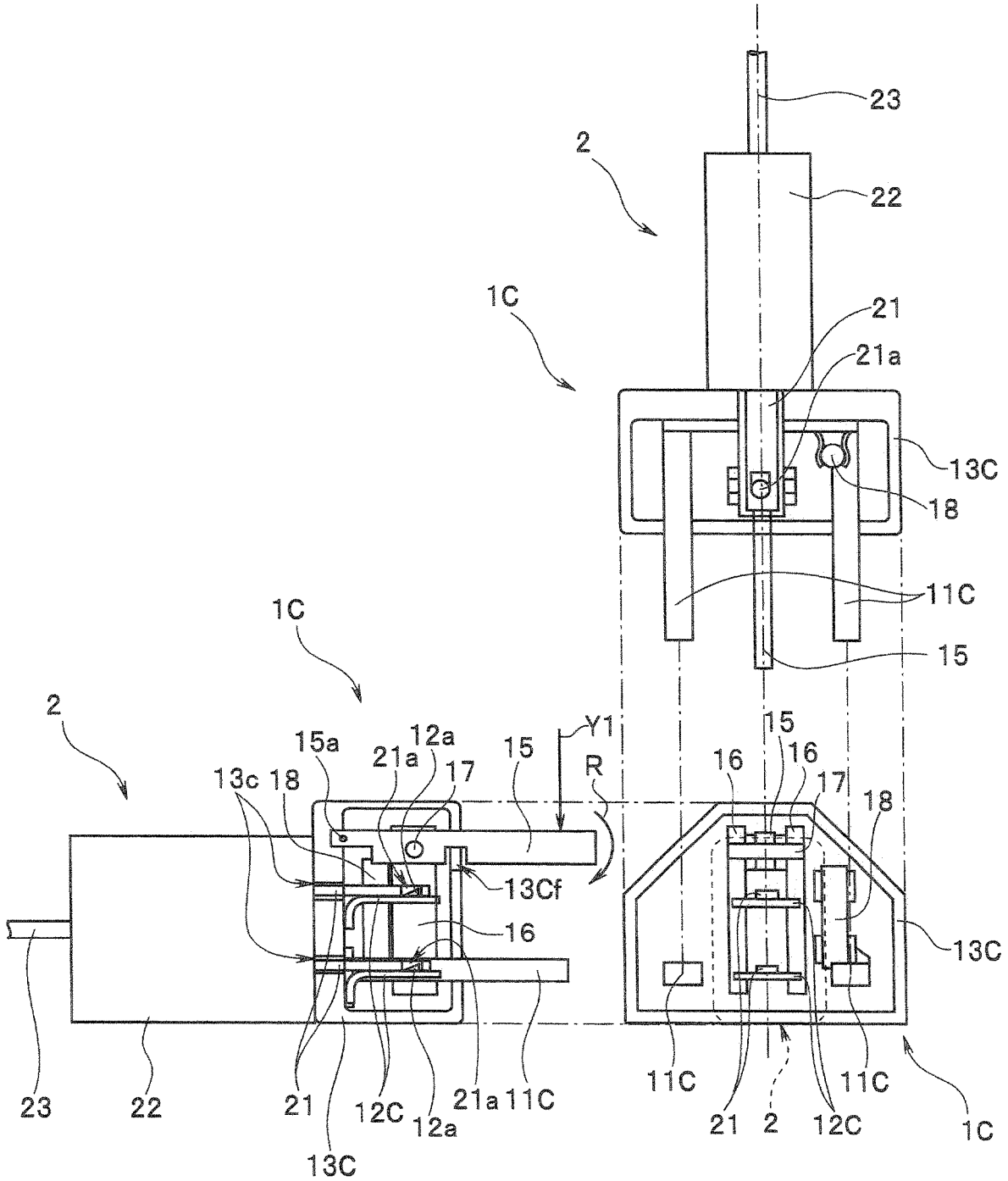
FIG. 19 is a trihedral view (top view, plan view, side view) showing an internal configuration of the power plug conversion unit of FIG. 18.
Figure 20:
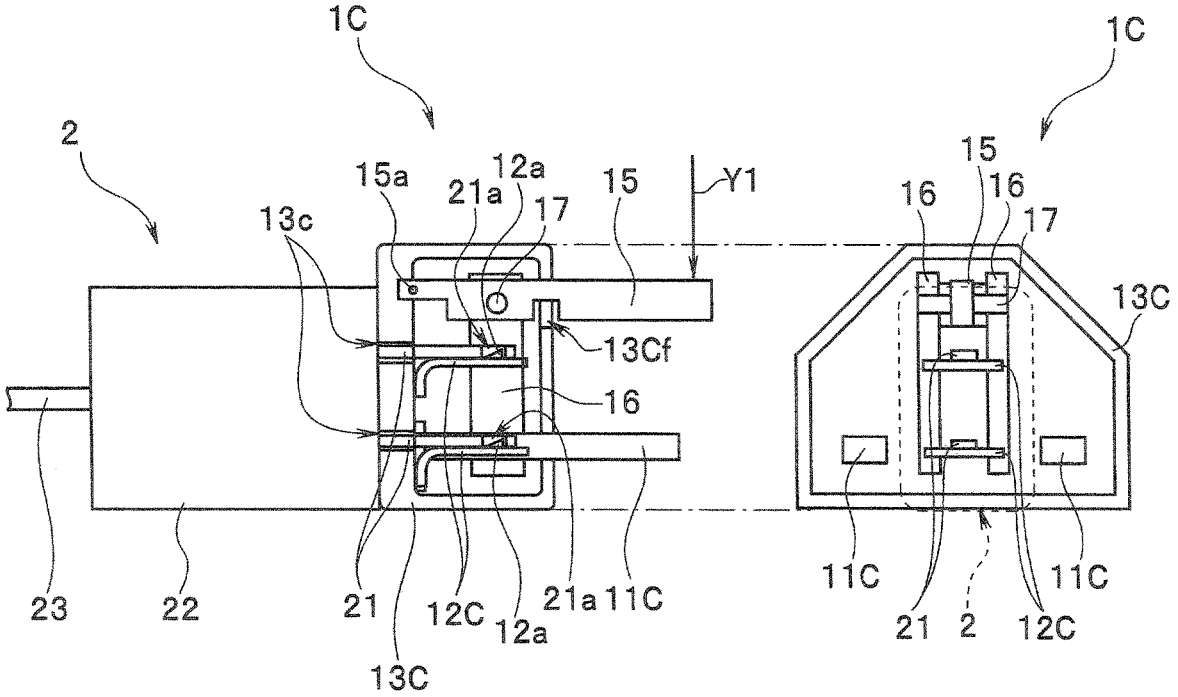
FIG. 20 is a diagram showing the operations of a power plug locking and unlocking mechanism when a locked state is released in the fifth modification of the power plug conversion unit according to the embodiment of the present invention (a normal state in use)

FIGS. 18 to 20 are diagrams showing the fifth modification of the power plug conversion unit according to the embodiment of the present invention, wherein FIG. 18 is an external appearance perspective view of the fifth modification of the power plug conversion unit of the embodiment of the present invention. Note that FIG. 18 also shows a power plug to be connected to the power plug conversion unit as well. Here, in FIG. 18, the power plug conversion unit and the power plug are in the non-connection state. FIG. 19 is a trihedral view (top view, plan view, side view) showing an internal configuration of the power plug conversion unit in the fifth modification. Note that in order to mainly show an internal mechanism of the power plug conversion unit in the present modification, illustration of components such as electrical wirings are omitted in FIG. 19. Furthermore, FIG. 19 also shows the power plug to be connected to the power plug conversion unit as well. Here, FIG. 19 shows a state where the power plug is connected to the power plug conversion unit.

Figure 21:
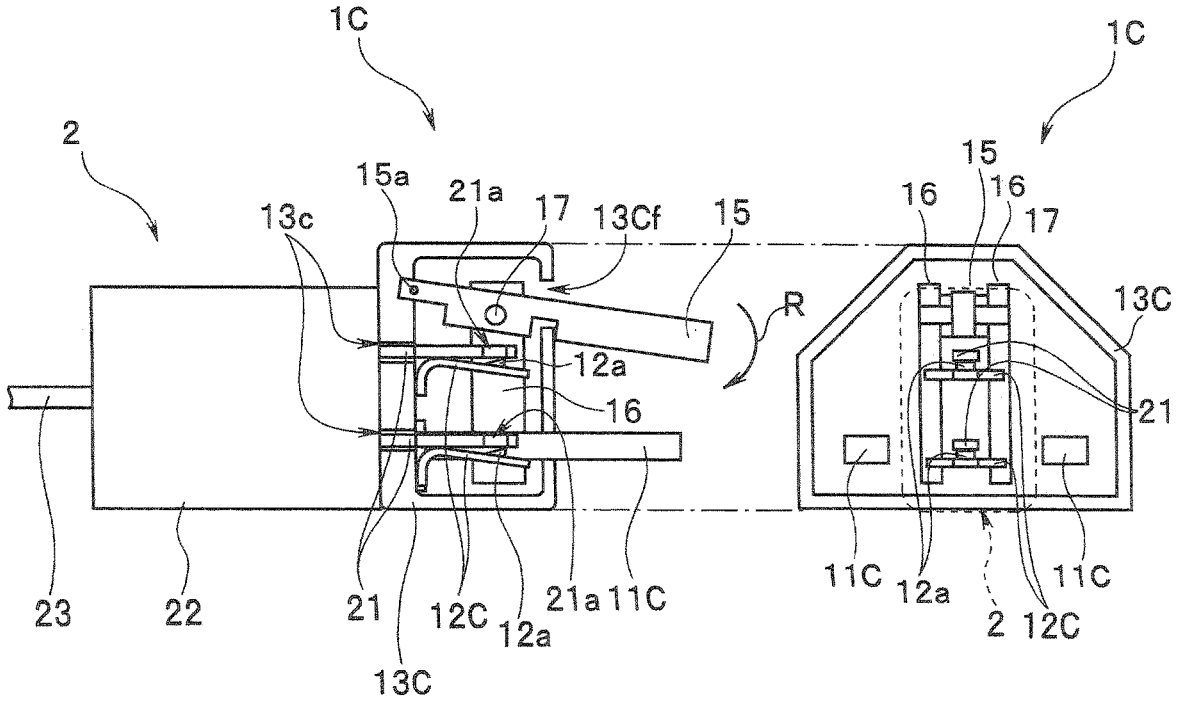
FIG. 21 is a diagram showing an unlocked state when an unlocking operation is performed in the state of FIG. 20.

FIGS. 20 and 21 are diagrams showing an operation of a power plug locking and unlocking mechanism when the locked state is released in the fifth modification of the power plug conversion unit according to the embodiment of the present invention, wherein FIG. 20 shows a state where the power plug conversion unit and the power plug are connected to each other, and shows a normal state in use, and FIG. 21 shows an unlocked state when an unlocking operation of applying a predetermined amount of force from a predetermined side to the ground blade under the state of FIG. 20 is performed. Note that in order to show the operation of the power plug locking and unlocking mechanism, illustration of components (for example, a fuse, etc.) other than the power plug locking and unlocking mechanism in the internal configuration is omitted in FIGS. 20 and 21.

The fifth modification shows a configuration in which by performing the turning operation (the turning operation in a direction of an arrow R in FIG. 18) on the ground blade, the ground blade acts on the leaf spring contact piece provided with the lock pawl to release the engagement between the lock pawl and the through-hole on the power plug side.

Note that the fifth modification is a configuration example in which the power plug 2 of type A is converted to a power plug of type BF (type G). Furthermore, the fifth modification is an example of a so-called straight type power plug conversion unit of a form in which the respective plug blades (plug pins) of the power plug conversion unit are formed to extend in a same direction as the plug blades (plug pins) of the power plug.

The power plug 2 is a power plug of type A of a general form which is configured to include a pair of power plug blades 21 which is a pair of first plug pins, a plug body 22 and a power cable 23. Here, each of the paired power plug blades 21 is provided with a through-hole 21*a* which is formed at a predetermined site near to a distal end of the power plug blade 21.

A configuration of the power plug 2 formed as described above is exactly similar to the configurations applied in the embodiment and the respective modifications described above. Accordingly, the description of the more detailed configuration of the power plug 2 is omitted.

A power plug conversion unit 1C in the present modification is formed in a form corresponding to a power plug of type BF (type G) having three flat blades (11C, 15).

In other words, the power plug conversion unit 1C is mainly configured by a pair of conversion plug blades 11C which is a pair of second plug pins, a ground blade 15 which is a third plug pin, a pair of leaf spring contact pieces 12C which is a pair of plate-like spring members (not shown in FIG. 18; see FIGS. 19 to 21), a conversion unit main body case 13C (abbreviated simply as a main body case 13C), a fuse 18, a power plug locking and unlocking mechanism (16, 17), etc.

The main body case 13C is a housing having an internal space. Paired first plug pin insertion portions 13*c* into which paired power plug blades 21 of the power plug 2 are respectively inserted are provided on one surface of the main body case 13C.

Three flat blades, that is, a pair of conversion plug blades 11C and a ground blade 15 are arranged so as to protrude outward from another surface opposite to the one surface of the main body case 13C. Here, the paired conversion plug blades 11C are fixed with respect to the fixed portion inside the main body case 13C.

The ground blade 15 is arranged to be turnable around a support shaft 15*a* (see FIG. 19) within a predetermined range in a direction along an arrow R of FIGS. 18 and 21 with respect to the fixed portion inside the main body case 13C.

Therefore, in the main body case 13C, a clearance hole 13Cf configured to allow the ground blade 15 to move by turning in the direction of the arrow R is provided at a portion where the ground blade 15 penetrates and protrudes.

Note that the ground blade 15 also functions as a shutter release pin configured to set a shutter member of a plug blade insertion port on an outlet side to an opened state. Therefore, the ground blade 15 is set to be slightly longer than the paired conversion plug blades 11C (so that the protrusion length is increased).

Each of the paired conversion plug blades 11C is connected to one end of each of the paired leaf spring contact pieces 12C fixed at a predetermined position inside the main body case 13C. In this case, for example, one contact piece 12C of the paired leaf spring contact pieces 12C is connected to one blade 11C of the paired conversion plug blades 11C. The other contact piece 12C is connected to the other blade 11C through the fuse 18. A specific wiring configuration of each of the paired conversion plug blades 11C and each of the paired leaf spring contact pieces 12C is a portion which is not directly related to the present invention, and thus omitted from the illustration.

Each of the paired leaf spring contact pieces 12C (see FIGS. 19 to 21) is arranged in an internal space communicating with each first plug pin insertion portion 13*c*. At this time, a proximal end portion of each of the paired leaf spring contact pieces 12C is fixed, for example, by using a fixing member such as a screw. As a result, the paired leaf spring contact pieces 12C are arranged in a cantilever style. The other end portion (the distal end portion) of each of the paired leaf spring contact pieces 12C is configured to be capable of sagging in the direction along the arrow R as a free end with the proximal end portion as a support shaft. In other words, the present modification is configured so that sagging directions of the respective distal end portions of the paired leaf spring contact pieces 12C are a same direction (R direction).

Note that the lock pawl 12*a* is formed in each of the paired leaf spring contact pieces 12C as in the case of the leaf spring contact pieces in each of the modifications described above. The lock pawl 12*a* has a function similar to the function of each of the modifications described above.

The paired leaf spring contact pieces 12C are coupled to each other by paired contact piece coupling plates 16. The paired contact piece coupling plates 16 hold both side surfaces of the paired leaf spring contact pieces 12C, that is, both side surface portions located in a direction substantially orthogonal to the sagging direction (the direction along the arrow R). The paired contact piece coupling plates 16 are coupled to each other by a right and left coupling plate coupling rod 17.

A part of the ground blade 15 is fixed to the right and left coupling plate coupling rod 17. In this case, the right and left coupling plate coupling rod 17 is fixed at a site slightly closer to the proximal end (the support shaft 15*a*) in a protruding direction of the ground blade 15 and in the internal space of the main body case 13C. Note that the paired contact piece coupling plates 16 and the right and left coupling plate coupling rod 17 are formed of a non-conductive material.

According to the configuration as described above, for example, a user applies an external load to the ground blade 15 in a direction along an arrow Y1 shown in FIGS. 19 and 20 by using user's fingers or the like.

At that moment, the ground blade 15 receives the load, and turns in the direction of the arrow R around the support shaft 15*a* as a turning center. At this time, the ground blade 15 presses down the right and left coupling plate coupling rod 17 in the direction of the arrow Y1. As a result, the right and left coupling plate coupling rod 17 moves the paired contact piece coupling plates 16 in the same direction of Y1.

At that moment, the paired contact piece coupling plates 16 cause the respective distal end portions of the paired leaf spring contact pieces 12C to sag in the direction of the arrow R. As a result, the engagement of the lock pawls 12*a* of the paired leaf spring contact pieces 12C with the respective through-holes 21*a* of the paired power plug blades 21 of the power plug 2 is released. Accordingly, the power plug 2 is allowed to be pulled out from the power plug conversion unit 1C.

Substantially the same effect of the embodiment and the respective modifications described above can also be obtained by the fifth modification as described above.

[Sixth Modification] (FIGS. 22 to 25)

Next, a sixth modification of the power plug conversion unit according to the embodiment of the present invention will be described below with reference to FIGS. 22 to 25.

Figure 22:
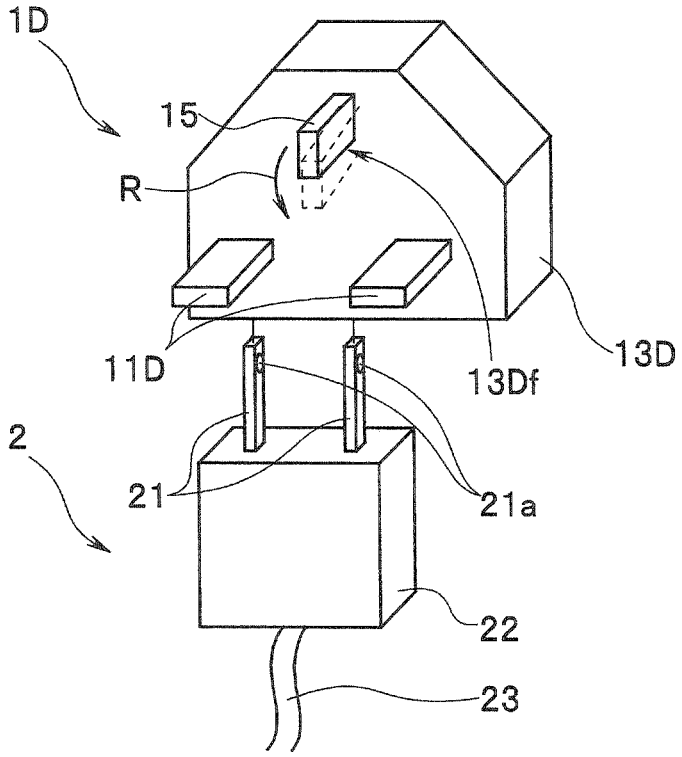
FIG. 22 is an external appearance perspective view showing a sixth modification of the power plug conversion unit according to the embodiment of the present invention.
Figure 23:
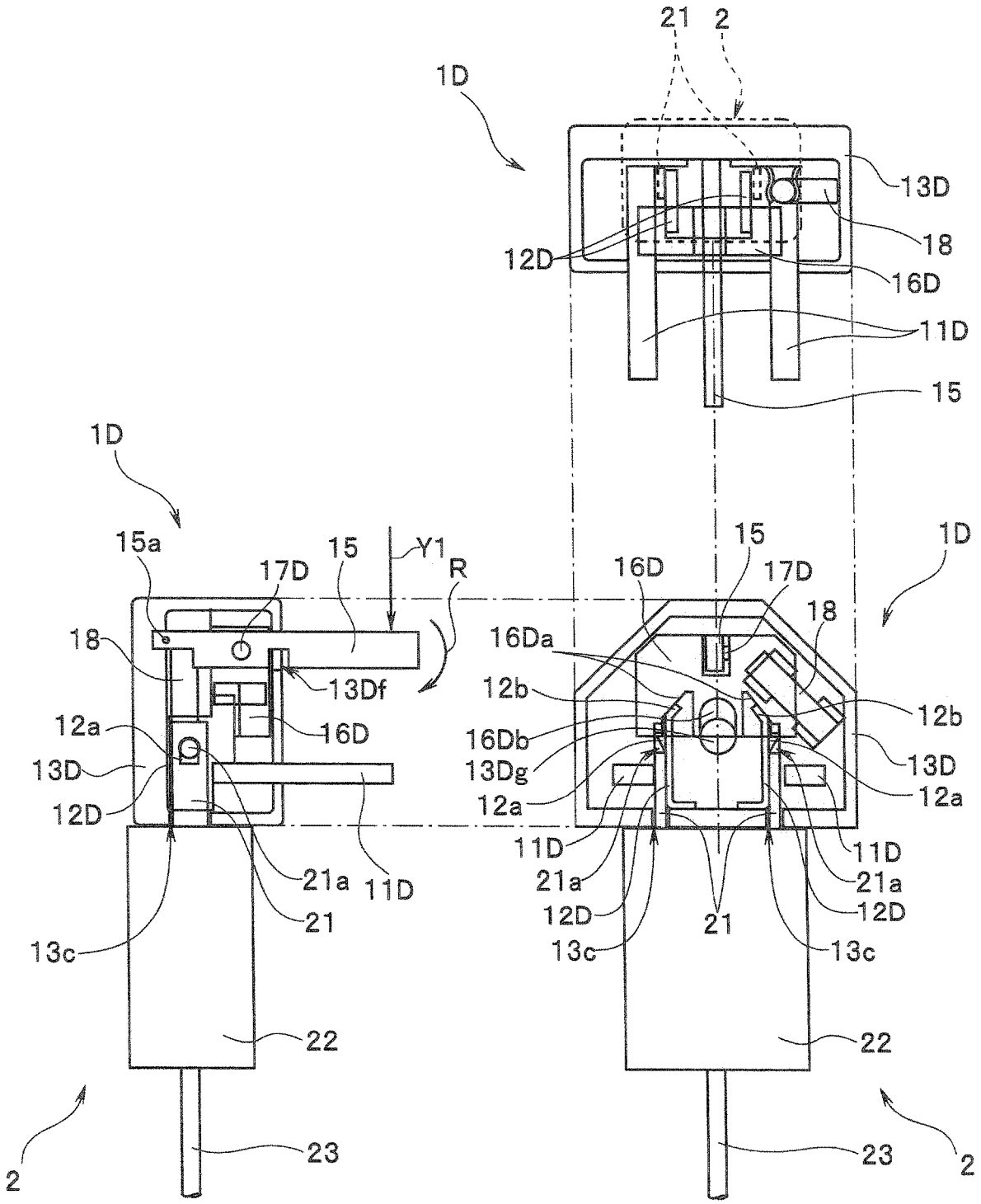
FIG. 23 is a trihedral view (top view, plan view, side view) showing an internal configuration of the power plug conversion unit of FIG. 22.

FIGS. 22 to 25 are diagrams showing the sixth modification of the power plug conversion unit according to the embodiment of the present invention, wherein FIG. 22 is an external appearance perspective view of the sixth modification of the power plug conversion unit according to the embodiment of the present invention. Note that FIG. 22 also shows a power plug to be connected to a power plug conversion unit as well. Here, in FIG. 22, the power plug conversion unit and the power plug are in a non-connection state. FIG. 23 is a trihedral view (top view, plan view, side view) showing an internal configuration of the power plug conversion unit in the sixth modification. Note that for the purpose of mainly showing an internal mechanism of the power plug conversion unit in the present modification, illustration of components such as electrical wirings are omitted in FIG. 23. Furthermore, FIG. 23 also shows the power plug to be connected to the power plug conversion unit as well. Here, FIG. 23 shows a state in which the power plug is connected to the power plug conversion unit.

Figure 24:
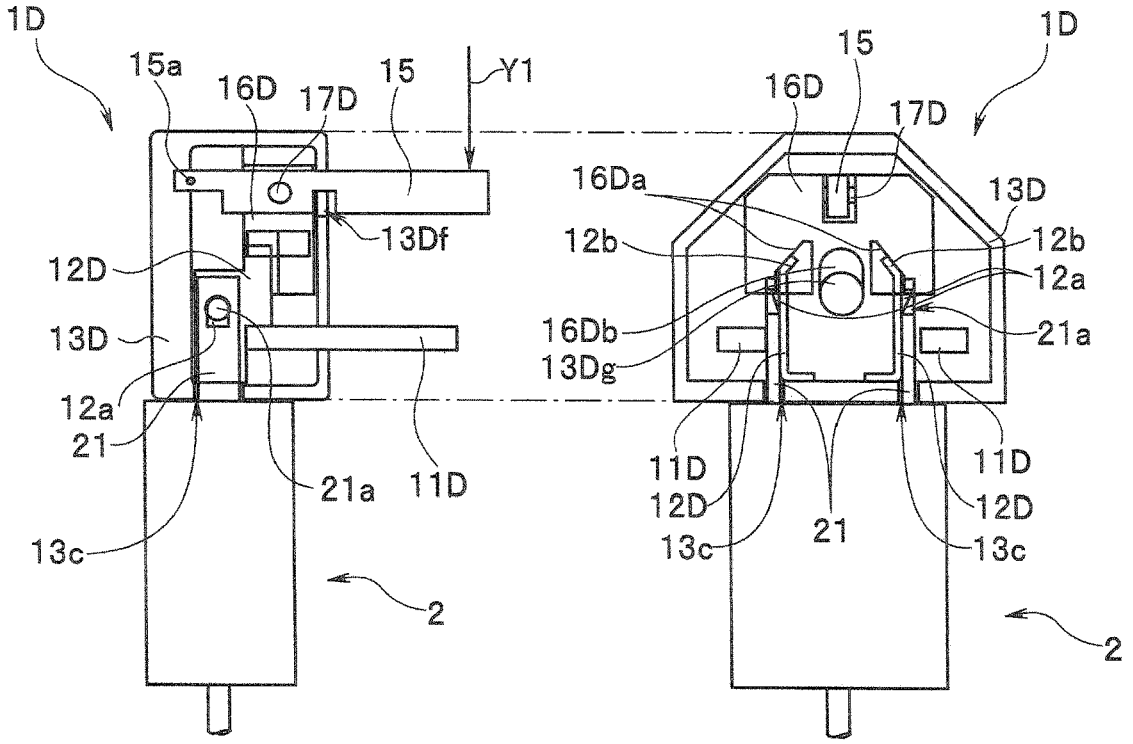
FIG. 24 is a diagram showing operations of a power plug locking and unlocking mechanism when the locked state is released in the sixth modification of the power plug conversion unit according to the embodiment of the present invention (a normal state in use)
Figure 25:
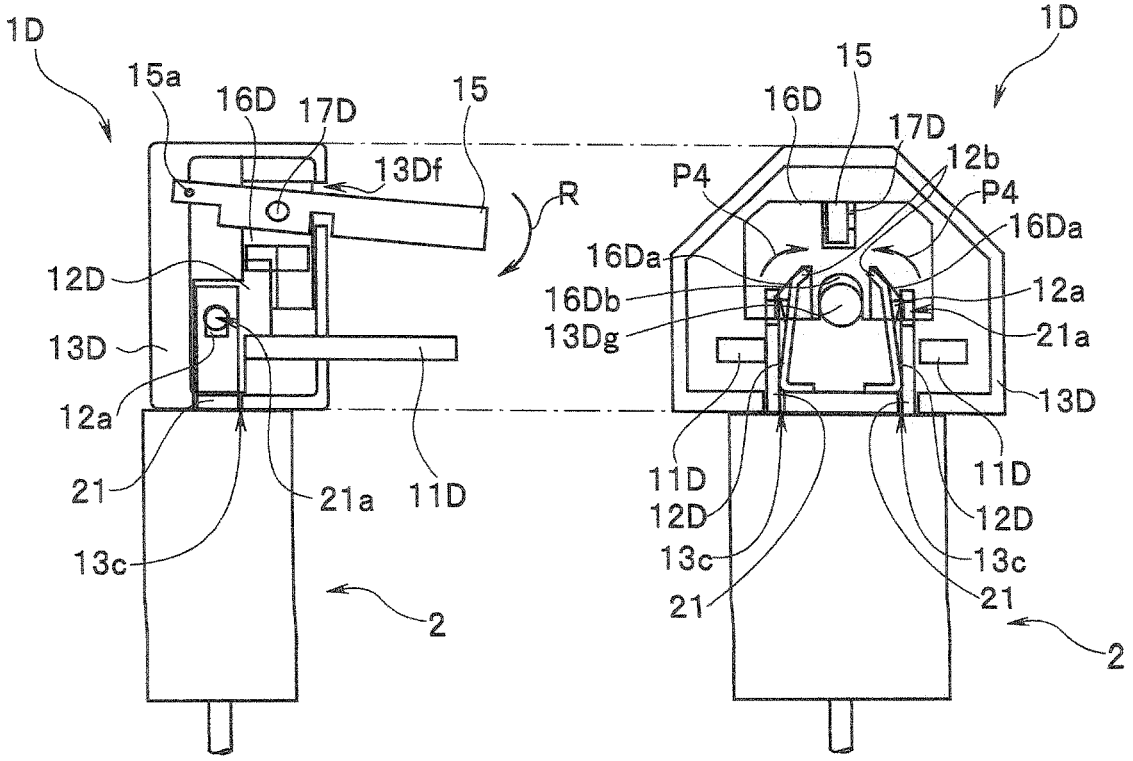
FIG. 25 is a diagram showing an unlocked state when an unlocking operation is performed in the state of FIG. 24.

FIGS. 24 and 25 are diagrams showing an operation of a power plug locking and unlocking mechanism when a locked state is released in the sixth modification of the power plug conversion unit according to the embodiment of the present invention, wherein FIG. 24 shows a state in which the power plug conversion unit and the power plug are connected to each other, and shows a normal state in use. FIG. 25 shows an unlocked state when an unlocking operation of applying a predetermined amount of force to a ground blade from a predetermined side under the state of FIG. 24. Note that in order to show the operation of the power plug locking and unlocking mechanism, illustration of components (for example, electrical wirings, a fuse, etc.) other than the power plug locking and unlocking mechanism in the internal configuration is omitted from FIGS. 24 and 25.

The sixth modification has a configuration in which the ground blade 15 acts on a paired leaf spring contact pieces 12D by performing a turning operation (the turning operation in the direction of the arrow R in FIG. 22) on the ground blade 15, thereby releasing an engagement state between a lock pawl 12*a* on a side of the leaf spring contact piece 12D and a through-hole 21*a* on a side of the power plug blade 21.

Note that the sixth modification is a configuration example in which the power plug 2 of type A is converted to a power plug of type BF (type G) as in the case of the aforementioned fifth modification. However, the sixth modification is an example of a so-called elbow type power plug conversion unit of a form in which the respective plug blades of the power plug conversion unit are formed to extend in a direction substantially orthogonal to the plug blades of the power plug.

A configuration of the power plug 2 is completely similar to the configurations applied to the embodiment and the respective modifications described above, and thus the detailed description of the configuration of the power plug 2 will be omitted.

A power plug conversion unit 1D in the present modification basically has substantially similar configuration shown in the fifth modification described above. The present modification differs from the fifth modification in the configurations of a main body case 13D adapted to an elbow type and a power plug locking and unlocking mechanism (16D, 17D, etc.) provided inside the main body case 13D.

In other words, the power plug conversion unit 1D is similar to the fifth modification described above in that the power plug conversion unit 1D is formed to have a form corresponding to the power plug of type BF (type G having three flat blades (11D, 15)).

The power plug conversion unit 1D is mainly configured by a pair of conversion plug blades 11D which is a pair of second plug pins, a ground blade 15 which is a third plug pin, a pair of leaf spring contact pieces 12D which is a pair of plate-like spring members (not shown in FIG. 22; see FIGS. 23 to 25), the main body case 13D (conversion unit main body case), a fuse 18, the power plug locking and unlocking mechanism (16D, 17D), and the like.

The main body case 13D is a housing having an internal space. Paired first plug pin insertion portions 13*c* in which paired power plug blades 21 of the power plug 2 are respectively inserted are provided on one surface of the main body case 13D.

The paired conversion plug blades 11D and the ground blade 15 are arranged so as to protrude outward from one surface of two surfaces orthogonal to the foregoing one surface of the main body case 13D. Furthermore, the ground blade 15 is arranged to be turnable around a support shaft 15*a* (see FIGS. 23 to 25) within a predetermined range in a direction along an arrow R of FIGS. 23 and 25 with respect to the fixed portion inside the main body case 13D. As described above, the configurations of the paired conversion plug blades 11D and the ground blade 15 are similar to the configurations of the fifth modification described above.

It is also similar to the fifth embodiment that in the main body case 13D, a clearance hole 13Df configured to allow the ground blade 15 to turn in the direction of the arrow R is also provided in a portion where the ground blade 15 penetrates and protrudes.

Each of the paired conversion plug blades 11D is connected to one end of each of the paired leaf spring contact pieces 12D fixed at a predetermined position inside the main body case 13D. A specific wiring configuration is omitted from illustration.

Each of the paired leaf spring contact pieces 12D (see FIGS. 23 to 25) is arranged in an internal space communicating with each first plug pin insertion portion 13*c*. The arrangement configuration of the paired leaf spring contact pieces 12D at this time is substantially the same as the arrangement configuration of the fifth modification described above.

However, the configuration of the fifth modification described above differs in that the sagging directions of the respective distal end portions of the paired leaf spring contact pieces 12C are the same direction. However, the present modification differs in that the paired leaf spring contact pieces 12D are configured so that respective distal end portions 12*b* (see FIGS. 24 and 25) sag in the mutually approaching direction (see an arrow P4 in FIG. 25).

In this case, the paired leaf spring contact pieces 12D are configured so that when the contact piece coupling plate 16D acts, the action causes the respective distal end portions 12*b* to sag in the mutually approaching direction (a direction of the arrow P4 in FIG. 25).

The contact piece coupling plate 16D is fixed to a part of the ground blade 15 by a coupling rod 17D inside the main body case 13D. Here, the coupling rod 17D is fixed at a site slightly closer to the proximal end (the support shaft 15*a*) in a protruding direction of the ground blade 15 and in the internal space of the main body case 13D. According to this configuration, when the ground blade 15 is turned in the direction of the arrow R, in conjunction with this turning, the contact piece coupling plate 16D moves in a direction substantially orthogonal to the protruding direction of the ground blade 15 (a direction along an arrow Y1 of FIGS. 23 and 24).

In the contact piece coupling plate 16D, a pair of notched sloped surface portions 16Da is formed at predetermined positions. When the contact piece coupling plate 16D is arranged at a predetermined position inside the main body case 13D, the pair of notched sloped surface portions 16Da is arranged at positions facing the respective distal end portions 12*b* of the paired leaf spring contact pieces 12D. Therefore, each distal end portion 12*b* of the paired leaf spring contact pieces 12D is formed to be bent at an angle substantially corresponding to each of the paired notched sloped surface portions 16Da. In this case, when the power plug conversion unit 1D is in a normal state, as shown in FIG. 23, it is desired that the bent portions of the respective distal end portions 12*b* of the paired leaf spring contact pieces 12D and the paired notched sloped surface portions 16Da are set to be substantially in a contact state. Note that the contact piece coupling plate 16D and the coupling rod 17D are formed of non-conductive members.

A guide groove 16Db configured to guide movement of the contact piece coupling plate 16D when the contact piece coupling plate 16D moves in conjunction with the turning of the ground blade 15 is formed in the contact piece coupling plate 16D. The guide groove 16Db is formed substantially linearly along the direction (the direction of the arrow Y1) in which the contact piece coupling plate 16D should move. The guide groove 16Db engages with a guide convex portion 13Dg formed on an inner surface of the main body case 13D.

Accordingly, according to the foregoing configuration, when the contact piece coupling plate 16D moves in conjunction with the turning of the ground blade 15, the guide convex portion 13Dg moves relatively along the guide groove 16Db. As a result, the contact piece coupling plate 16D is configured to move only in a predetermined direction (a moving direction (the direction of the arrow Y1) in which the contact piece coupling plate 16D is pressed when the ground blade 15 turns).

According to the configuration as described above, for example, the user applies an external load to the ground blade 15 in the direction along the arrow Y1 shown in FIGS. 23 and 24 by using user's fingers or the like.

At that moment, the ground blade 15 receives the load, and turns in the direction of the arrow R around the support shaft 15*a* as a turning center. At this time, the ground blade 5 presses down the coupling rod 17 in the direction of the arrow Y1. As a result, the coupling rod 17 moves the contact piece coupling plate 16D in the same direction of Y1.

At that moment, the contact piece coupling plate 16D causes the respective distal end portions 12*b* of the paired leaf spring contact pieces 12D to sag in the mutually approaching direction (a direction of an arrow P4 in FIG. 25). As a result, the engagement of the lock pawls 12*a* of the paired leaf spring contact pieces 12D with the respective through-holes 21*a* of the paired power plug blades 21 of the power plug 2 is released, whereby the power plug 2 can be pulled out from the power plug conversion unit 1D.

By the sixth modification as described above, substantially the same effect of the embodiment and the respective modifications described above can also be obtained.

Figure 26:
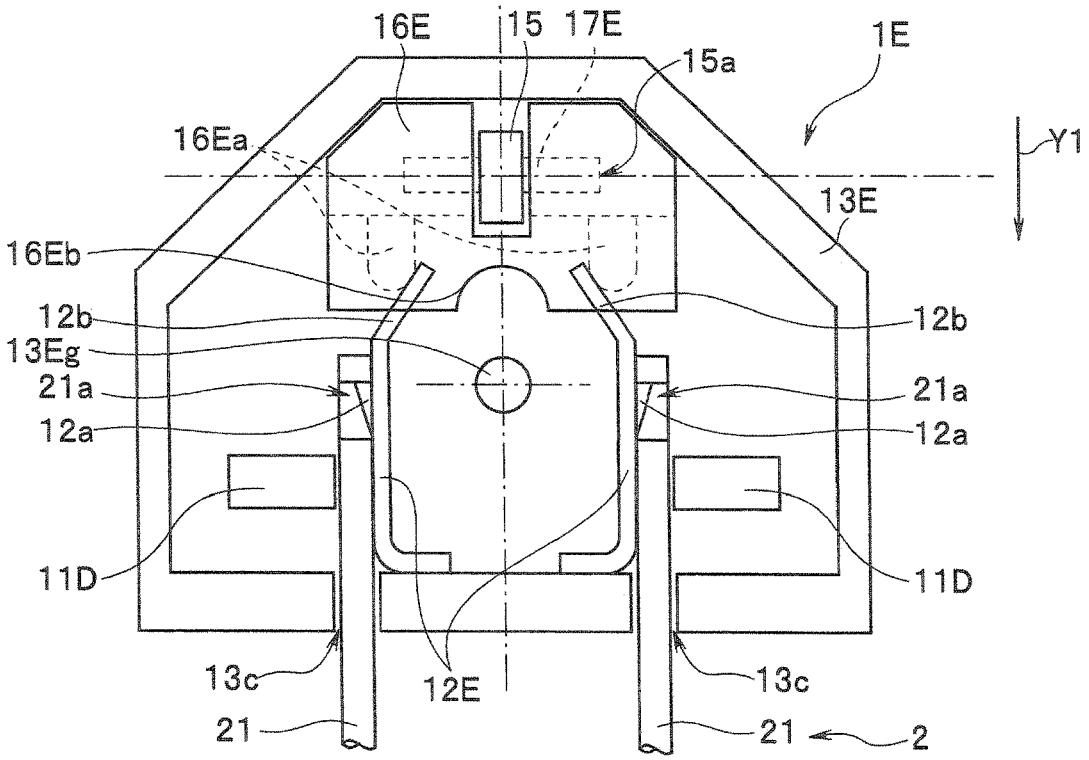
FIG. 26 is a schematic plan view showing an internal configuration of a seventh modification of the power plug conversion unit according to an embodiment of the present invention (a normal in-use state)
Figure 27:
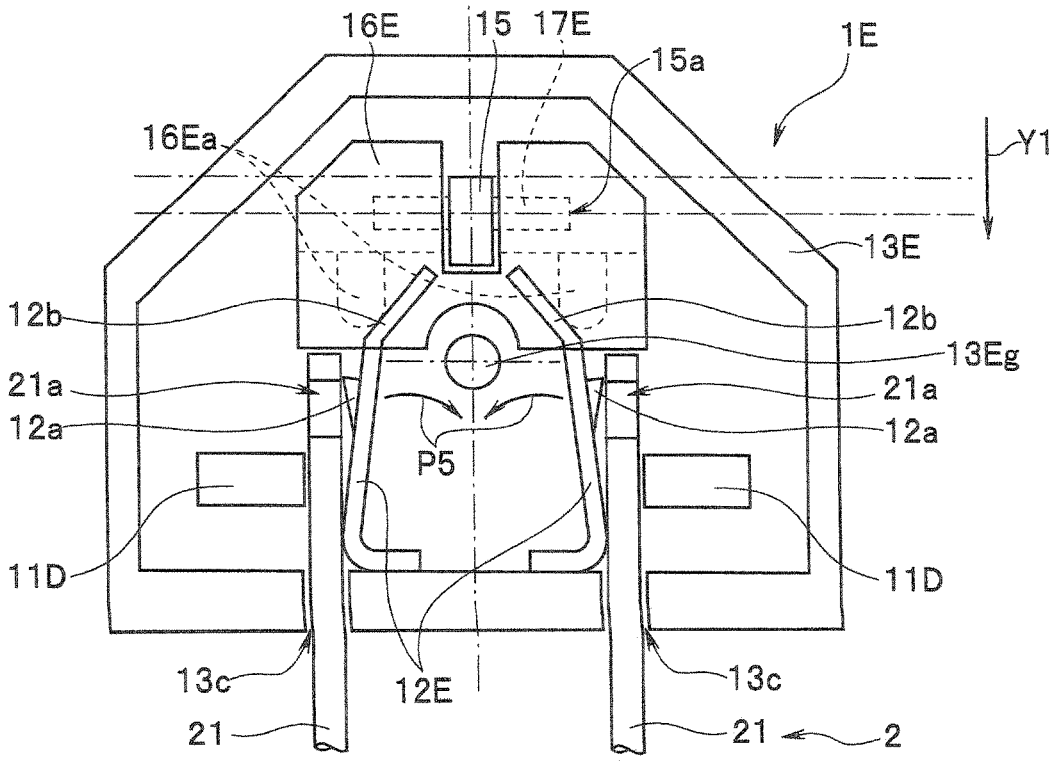
FIG. 27 is a plan view showing an operation state of the power plug conversion unit (the unlocked state when the unlocking operation is performed) in the state of FIG. 26.

[Seventh Modification] (FIGS. 26 and 27)

Next, a seventh modification of the power plug conversion unit according to the embodiment of the present invention will be described below with reference to FIGS. 26 and 27.

FIGS. 26 and 27 are diagrams schematically showing an internal configuration of the seventh modification of the power plug conversion unit according to the embodiment of the present invention, wherein FIG. 26 is a plan view showing a state in which the power plug is connected to the power plug conversion unit in the present modification, and showing a state in normal use, and FIG. 27 is a plan view showing an operating state of the power plug conversion unit in the state of FIG. 26, that is, an unlocked state when an unlocking operation is performed by applying a predetermined amount of force to a ground blade from a predetermined side.

Note that in order to show an operation of a power plug locking and unlocking mechanism, illustration of components (for example, electrical wirings, a fuse, etc.) other than the power plug locking and unlocking mechanism in the internal configuration is omitted in FIGS. 26 and 27.

A basic configuration of the seventh modification is similar to the configuration of the sixth modification. The seventh modification is slightly different from the sixth modification in a configuration of a contact piece coupling plate 16E that moves in a predetermined direction (a direction of an arrow Y1 in FIGS. 26 and 27) in conjunction with a turning operation of the ground blade 15 and acts on paired leaf spring contact pieces 12E, thereby releasing an engagement state between lock pawls 12*a* on a side of the leaf spring contact pieces 12E and through-holes 21*a* on a side of the power plug blades 21. Therefore, with respect to the configuration similar to the configuration of the above-described sixth modification, detailed description is omitted, and only different portions will be described below in detail.

The seventh modification is a configuration example when the power plug 2 of type A is converted to a power plug of type BF (type G) as in the case of the above-described sixth modification, and an example of an elbow type power plug conversion unit is shown.

A configuration of the power plug 2 is completely similar to the configuration applied to the embodiment and the respective modifications described above.

In the power plug conversion unit 1E according to the present modification, the contact piece coupling plate 16E constituting the power plug locking and unlocking mechanism is fixed to a part of the ground blade 15 by a coupling rod 17E inside the main body case 13E. According to this configuration, when the ground blade 15 is turned in a direction of an arrow R (not shown in FIGS. 26 and 27; see FIG. 25) and moved in a direction of an arrow Y1 in FIGS. 26 and 27, in conjunction with this movement, the contact piece coupling plate 16E also moves in the direction of the arrow Y1.

A pair of projecting portions 16Ea is formed on an inner surface side of the contact piece coupling plate 16E. The paired projecting portions 16Ea are arranged at positions facing respective distal end portions 12*b* of the paired leaf spring contact pieces 12E when the contact piece coupling plate 16E is arranged at a predetermined position inside the main body case 13E. Therefore, the distal end portions 12*b* of the paired leaf spring contact pieces 12E are formed to bend at predetermined angles and formed so as to have inclination angles with respect to the paired projecting portions 16Ea. In this case, when the power plug conversion unit 1E is in a normal state, as shown in FIG. 26, it is desired that a bent portion of the distal end portion 12*b* of each of the paired leaf spring contact pieces 12E and a distal end of each of the paired projecting portions 16Ea are set to be in a substantially contact state. Note that the contact piece coupling plate 16E and the coupling rod 17E are formed of non-conductive members.

A notched portion 16Eb configured to restrict the turning of the ground blade 15 within a predetermined range is formed in the contact piece coupling plate 16E. When the contact piece coupling plate 16E moves in the direction of the arrow Y1 in conjunction with the turning of the ground blade 15, the notched portion 16Eb engages with a guide convex portion 13Eg formed on an inner surface of the main body case 13E, whereby the turning of the ground blade 15 is restricted.

According to the configuration as described above, for example, a user applies an external load to the ground blade 15 in the direction along the arrow Y1 shown in FIG. 26 by using user's fingers or the like.

At that moment, the ground blade 15 receives the load and turns in a predetermined direction (a direction corresponding to the direction of the arrow R in FIG. 25 of the sixth modification) around the support shaft 15*a* as a turning center. At this time, the ground blade 15 presses down the coupling rod 17E in the direction of the arrow Y1. As a result, the coupling rod 17E moves the contact piece coupling plate 16E in the same direction of Y1.

At that moment, each of the paired projecting portions 16Ea presses the distal end portion 12*b* of each of the paired leaf spring contact pieces 12E in the same direction of Y1. As a result, the respective distal end portions 12*b* of the paired leaf spring contact pieces 12E sag in the mutually approaching direction (a direction of an arrow P5 in FIG. 27). As a result, the engagement of the lock pawls 12*a* of the paired leaf spring contact pieces 12E with the respective through-holes 21*a* of the paired power plug blades 21 of the power plug 2 is released. Accordingly, the power plug 2 can be pulled out from the power plug conversion unit 1E.

According to the seventh modification described above, substantially the same effect of the embodiment and the respective modifications described above can also be obtained.

Figure 28:
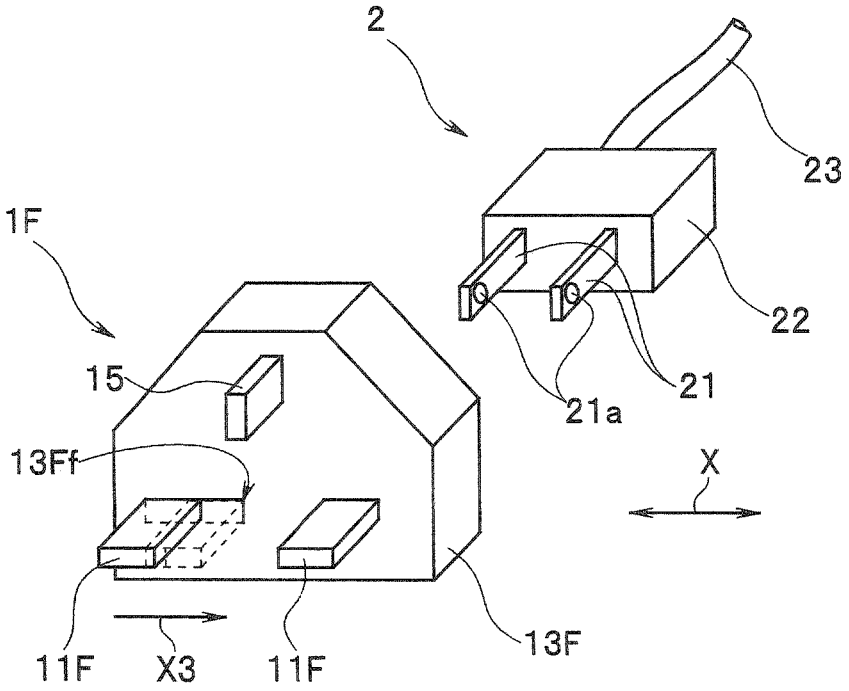
FIG. 28 is an external appearance perspective view showing an eighth modification of the power plug conversion unit according to the embodiment of the present invention.
Figure 29:
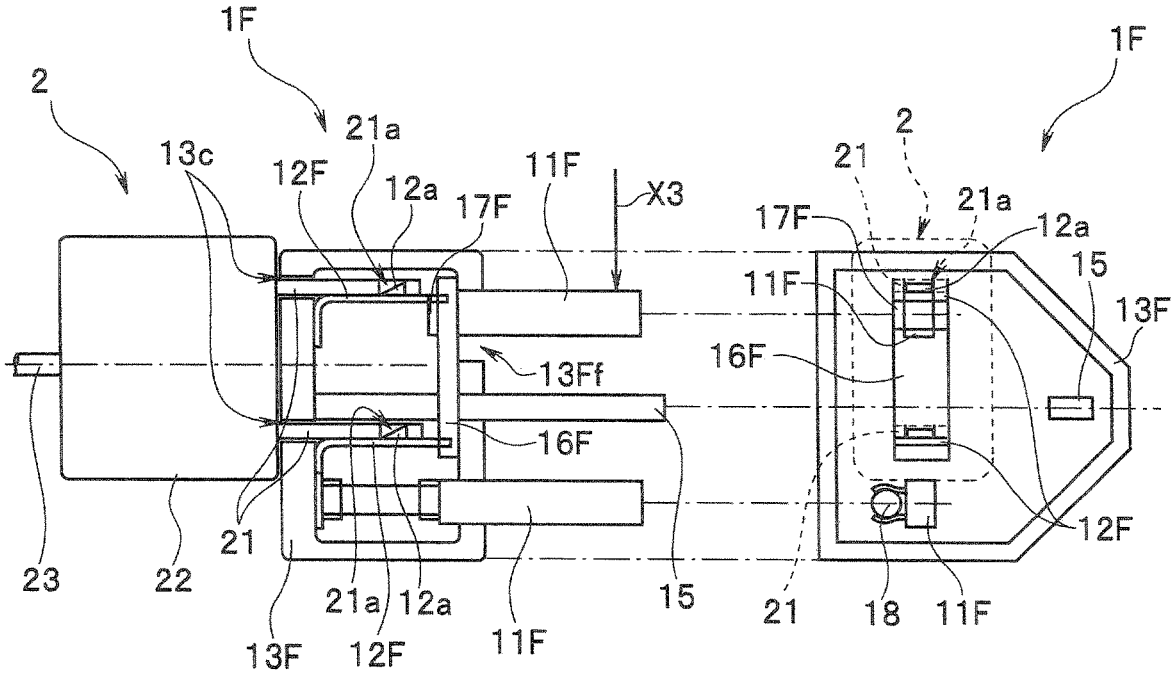
FIG. 29 is a diagram (plan view, side view) showing an internal configuration of the power plug conversion unit of FIG. 28.
Figure 30:
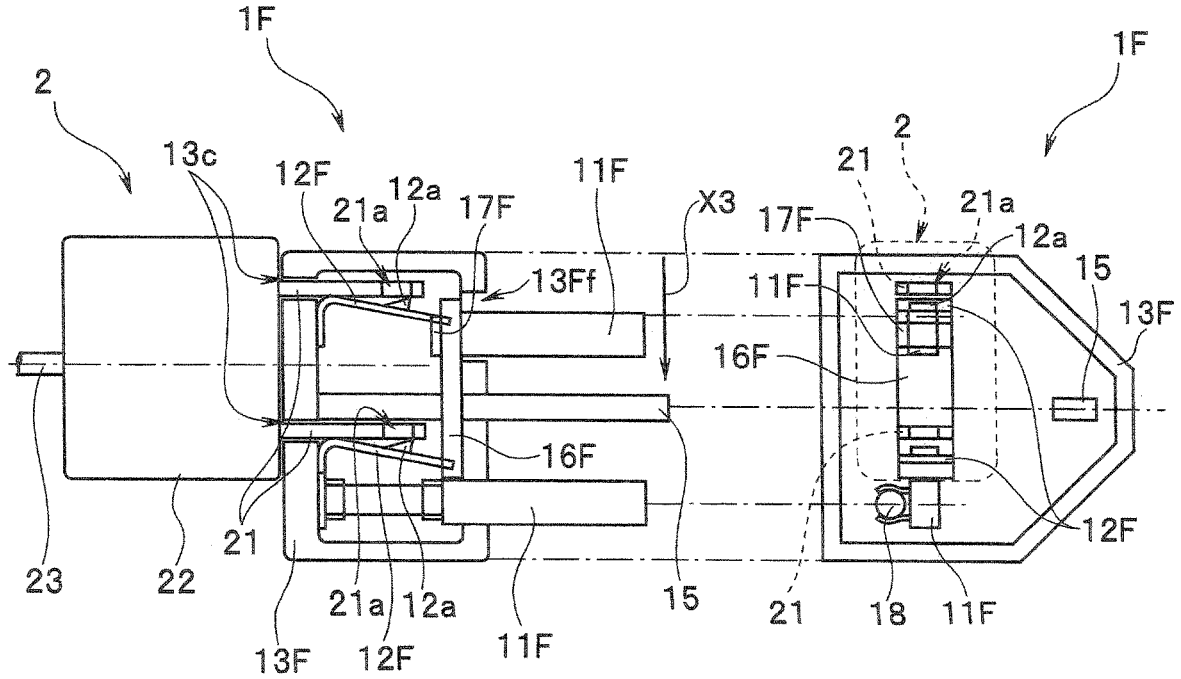
FIG. 30 is a diagram showing operations of a power plug locking and unlocking mechanism when a locked state is released in the power plug conversion unit under the state of FIG. 29 (unlocked state)

[Eighth Modification] (FIGS. 28 to 30)

Next, an eighth modification of the power plug conversion unit according to the embodiment of the present invention will be described below with reference to FIGS. 28 to 30.

FIGS. 28 to 30 show an eighth modification of the power plug conversion unit according to the embodiment of the present invention, wherein FIG. 28 is an external appearance perspective view of the eighth modification of the power plug conversion unit according to the embodiment of the present invention. Note that FIG. 28 also shows a power plug connected to the power plug conversion unit as well. Here, in FIG. 28, the power plug conversion unit and the power plug are in a non-connection state.

FIG. 29 is a diagram (plan view, side view) showing an internal configuration of a power plug conversion unit according to the eighth modification. Here, FIG. 29 shows a state where the power plug conversion unit and the power plug are connected to each other, and shows a normal state in use. Note that for the purpose of mainly showing an internal mechanism of the power plug conversion unit in the present modification, illustration of components such as electrical wirings is omitted In FIG. 29. Furthermore, FIG. 29 also shows the power plug connected to the power plug conversion unit as well. Here, FIG. 29 shows a state where the power plug is connected to the power plug conversion unit.

FIG. 30 is a diagram showing an operation of the power plug locking and unlocking mechanism when the locked state in the power plug conversion unit under the state of FIG. 29 is released. Here, FIG. 30 shows an unlocked state when an unlocking operation of applying a predetermined amount of force from a predetermined side to one blade of the paired conversion plug blades from the state of FIG. 29.

The eighth modification shows a configuration in which one of paired conversion plug blades 11F is subjected to a pressing and moving operation (a moving operation in the direction of an arrow X3 in FIG. 28 (a direction orthogonal to a projecting direction of the blades)), whereby the one conversion plug blade 11F acts on paired leaf spring contact pieces 12F to release the engagement between the lock pawls 12*a* of the paired leaf spring contact pieces 12F and the through-holes 21*a* of the power plug blades 21.

The eighth modification is a configuration example in which the power plug 2 of type A is converted to a power plug of type BF (type G), and is an illustrated example of a straight type power plug conversion unit. The eighth modification is similar to the aforementioned fifth modification in this point.

On the other hand, the eighth modification differs from the fifth modification in the arrangement direction of the paired power plug blades. In other words, with respect to the arrangement direction of the paired power plug blades, the difference is that the paired power plug blades are arranged to be aligned in the direction of the arrow Y of FIG. 18 in the fifth modification, whereas the paired power plug blades are arranged to be aligned in the direction of an arrow X of FIG. 28 in the present modification. Therefore, the fifth modification is configured so that the paired leaf spring contact pieces are moved by performing the turning operation on the ground blade 15, whereas the present modification is configured so that the paired leaf spring contact pieces 12F are moved by performing the pressing and moving operation on one of the paired conversion plug blades 11F.

The configuration of the power plug 2 is completely the same as the configuration applied to the embodiment and the respective modifications described above.

The power plug conversion unit 1F is mainly configured by a pair of conversion plug blades 11F which is a pair of second plug pins, a ground blade 15 which is a third plug pin, a pair of leaf spring contact pieces 12F which is a pair of plate-like spring members (not shown in FIG. 28; see FIGS. 29 and 30), a conversion unit main body case 13F (abbreviated simply as a main body case 13F), a fuse 18, a power plug locking and unlocking mechanism (16F, 17F), etc.

The main body case 13F is a housing having an internal space. A pair of first plug pin insertion portions 13*c* into which the paired power plug blades 21 of the power plug 2 are respectively inserted are provided on one surface of the main body case 13F.

Three flat blades, that is, the paired conversion plug blades 11F and the ground blade 15 are arranged to project outward from another surface opposite to the one surface of the main body case 13F.

Here, one conversion plug blade 11F of the paired conversion plug blades 11F is fixed to a part of a contact piece connecting plate 16F in a power plug locking and unlocking mechanism described later inside the main body case 13F. Furthermore, the proximal end portion of the one conversion plug blade 11F is connected to one leaf spring contact piece 12F of the paired leaf spring contact pieces 12F via a coupling rod 17 of the power plug locking and unlocking mechanism.

The other conversion plug blade 11F of the paired conversion plug blades 11F is connected and fixed to one end of the fuse 18 inside the main body case 13F. The ground blade 15 is fixed to a fixed portion inside the main body case 13F.

On the other hand, the paired leaf spring contact pieces 12F are respectively fixed at predetermined positions inside the main body case 13F. Here, each of the paired leaf spring contact pieces 12F are arranged in the vicinity of each of the paired first plug pin insertion portions 13*c*. When each of the paired power plug blades 21 of the power plug 2 is inserted into each of the paired first plug pin insertion portions 13*c*, each of the paired power plug blades 21 is brought into contact with and electrically connected to each of the paired leaf spring contact pieces 12F (see a state shown in FIG. 29).

A distal end portion of each of the paired leaf spring contact pieces 12F is fixed at a predetermined position to a part of the contact piece connecting plate 16F. In other words, the paired leaf spring contact pieces 12F are connected to each other by the contact piece connecting plate 16F. Note that the contact piece connecting plate 16F is formed of a non-conductive member.

Accordingly, according to this configuration, when one conversion plug blade 11F of the paired conversion plug blades 11F is moved in the direction of an arrow X3 in FIG. 28, the contact piece connecting plate 16F also moves in the same direction inside the main body case 13F. As a result, the distal end portions of the paired leaf spring contact pieces 12F move in the direction of the arrow X3 together with the contact piece connecting plate 16F. Accordingly, both of the distal end portions of the paired leaf spring contact pieces 12F sag in the direction of the arrow X3.

As described above, since one conversion plug blade 11F of the paired conversion plug blades 11F moves in the direction of the arrow X3 in FIG. 28, a clearance hole 13Ff configured to allow the movement of the one conversion plug blade 11F in the direction of the arrow X3 is provided at a portion where the one conversion plug blade 11F penetrates and protrudes in the main body case 13F. The other configuration is substantially the same as the configuration of the embodiment and the respective modifications described above.

According to the configuration as described above, for example, the user uses a finger or the like to apply an external load to the one conversion plug blade 11F of the paired conversion plug blade 11F in the direction of the arrow X3 shown in FIGS. 28 and 29.

At that moment, the one conversion plug blade 11F receives the load and moves in the direction of the arrow X3. At this time, the one conversion plug blade 11F moves the contact piece connecting plate 16F in the direction of the arrow X3. In conjunction with this movement, the distal end portions of the paired leaf spring contact pieces 12F also move in the same direction X3 together with the contact piece connecting plate 16F, thereby causing the distal portions of the paired leaf spring contact pieces 12F to sag in the direction of the arrow X3. As a result, the engagement of the lock pawls 12*a* of the paired leaf spring contact pieces 12F with the through-holes 21*a* of the paired power plug blades 21 of the power plug 2 is released. Therefore, the power plug 2 can be pulled out from the power plug conversion unit 1F.

According to such an eighth modification, substantially the same effect as the effect of the embodiment and the respective modifications described above can be obtained.

[Ninth Modification] (FIGS. 31 to 34)

Next, a ninth modification of the power plug conversion unit according to the embodiment of the present invention will be described below with reference to FIGS. 31 to 34.

Figure 31:
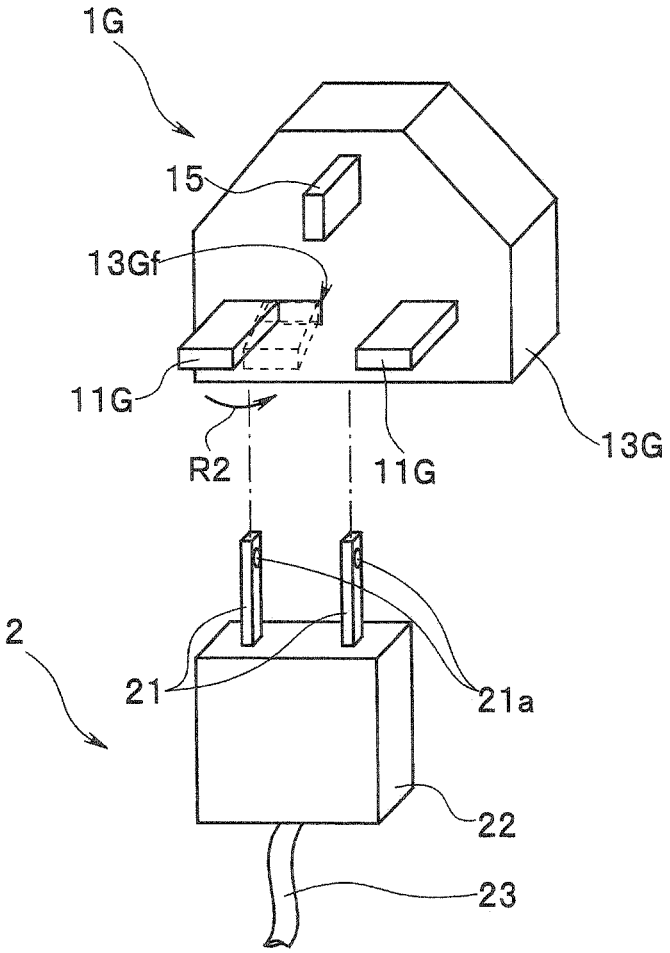
FIG. 31 is an external appearance perspective view showing a ninth modification of the power plug conversion unit according to the embodiment of the present invention.

FIGS. 31 to 34 are diagrams showing the ninth modification of the power plug conversion unit according to the embodiment of the present invention, wherein FIG. 31 is an external appearance perspective view of a ninth modification example of the power plug conversion unit according to the embodiment of the present invention. Note that FIG. 31 shows the power plug connected to the power plug conversion unit as well. Here, in FIG. 31, the power plug conversion unit and the power plug are set to be in a non-connection state.

Figure 32:
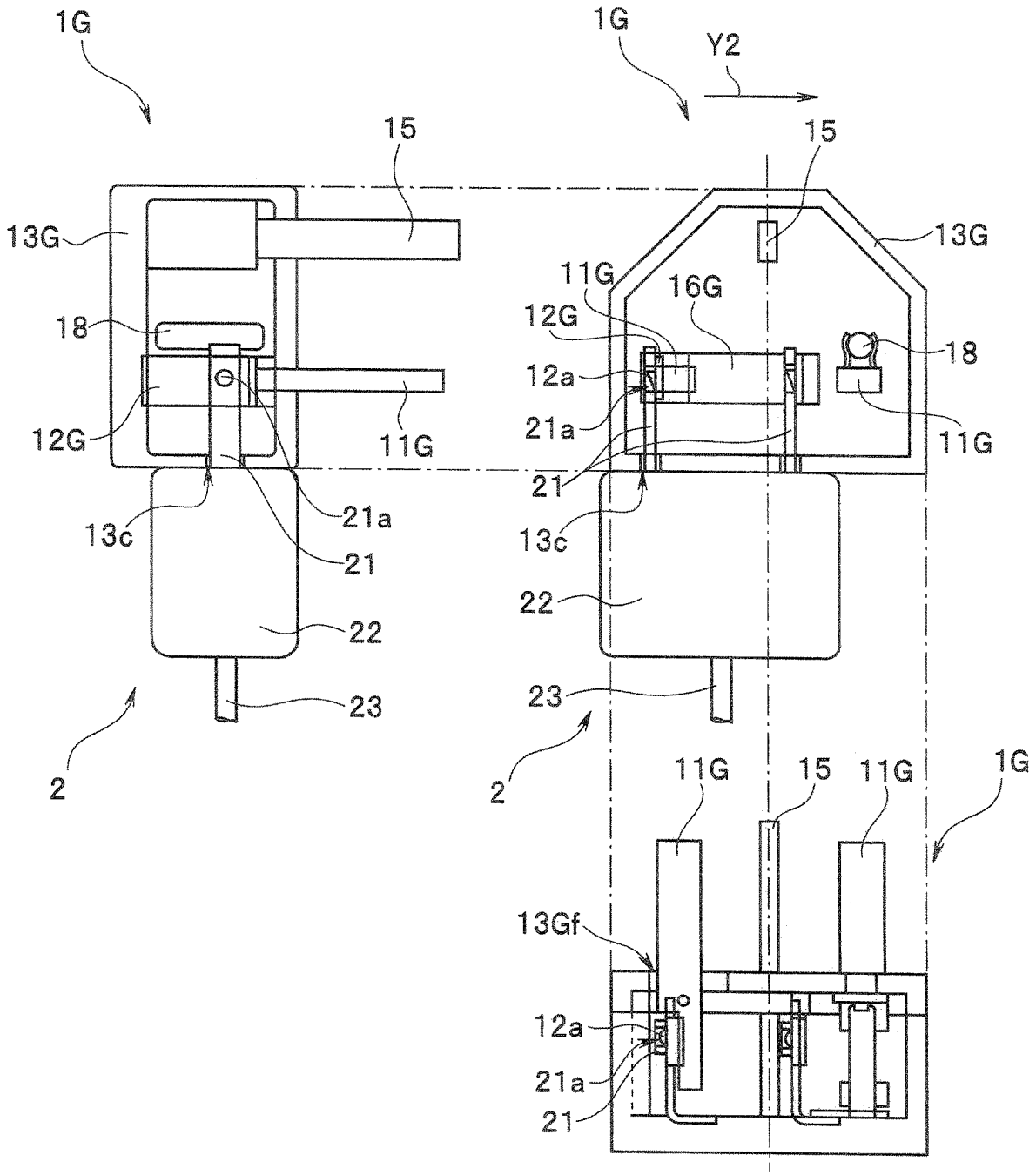
FIG. 32 is a trihedral view (top view, plan view, side view) showing an internal configuration of the power plug conversion unit of FIG. 31.
Figure 33:
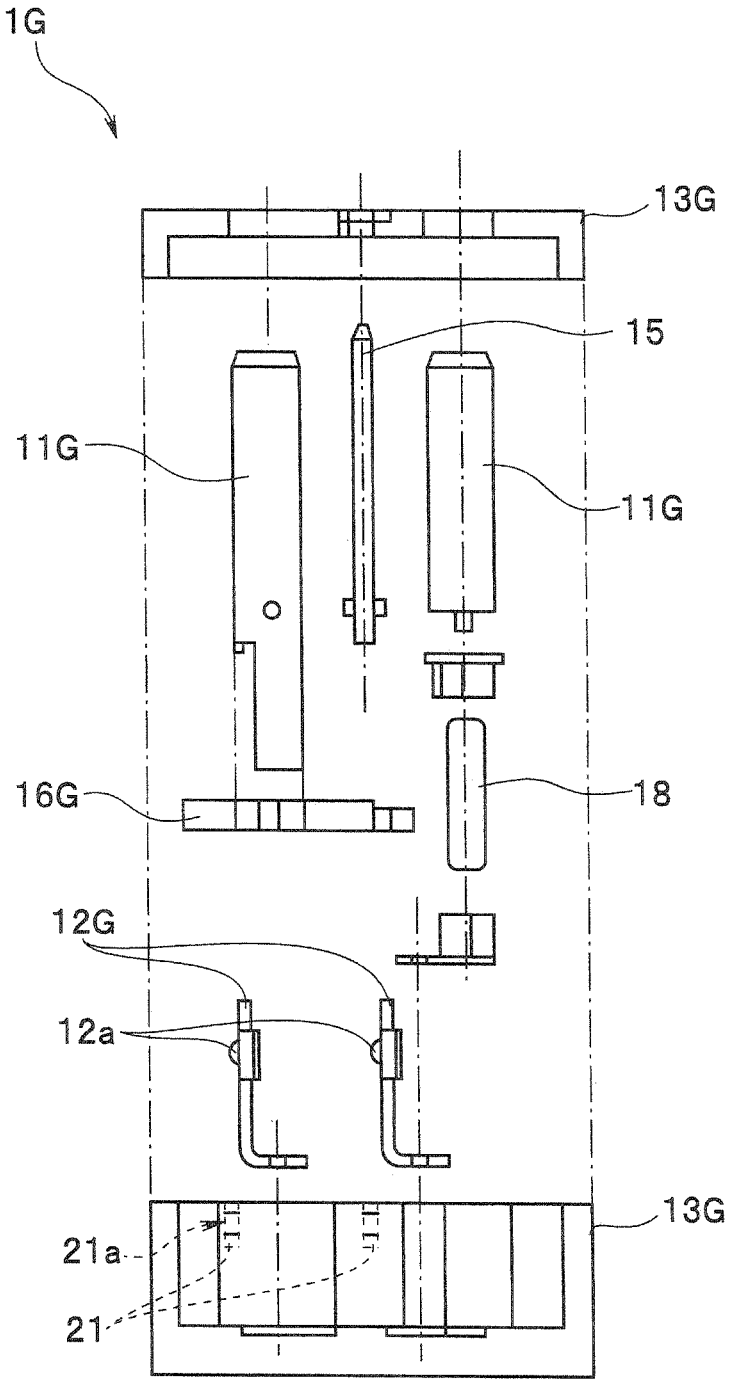
FIG. 33 is an exploded configuration diagram of the power plug conversion unit of FIG. 31.

FIG. 32 is a trihedral view (top view, plan view, side view) showing an internal configuration of the power plug conversion unit according to the ninth modification. Note that in order to mainly show an internal mechanism of the power plug conversion unit in the present modification, illustration of components such as electrical wirings is omitted in FIG. 32. Furthermore, FIG. 32 also shows power plug connected to the power plug conversion unit as well. Here, FIG. 32 shows a state in which the power plug is connected to the power plug conversion unit. FIG. 33 is an exploded configuration diagram showing the power plug conversion unit according to the present modification.

Figure 34:
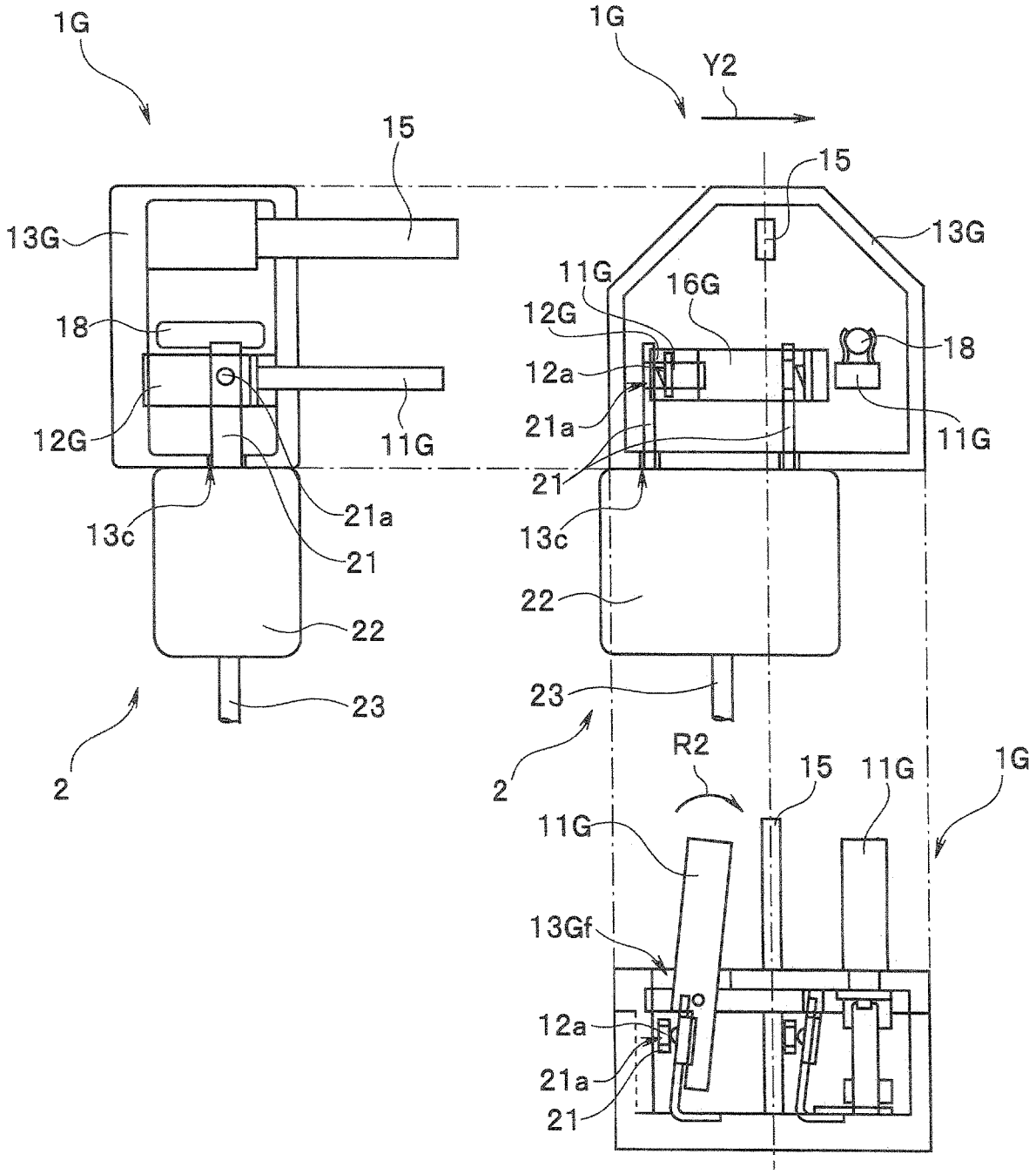
FIG. 34 shows a trihedral view showing operations of a power plug locking and unlocking mechanism when a locked state of the power plug conversion unit of FIG. 31 is released (an unlocked state).

FIG. 34 is a trihedral view (top view, plan view, side view) showing the operation (unlocked state) of the power plug locking and unlocking mechanism when the locked state in the ninth modification of the power plug conversion unit according to the embodiment of the present invention is released. In order to show the power plug locking and unlocking mechanism, illustration of components (for example, electrical wirings, etc.) other than the power plug locking and locking release mechanism in the internal configuration is omitted in FIGS. 33 and 34.

The basic configuration of the ninth modification is substantially the same as the eighth modification described above. In other words, the present modification is a configuration example in which the power plug 2 of type A is converted to a power plug of type BF (type G) as in the case of the above-described eighth modification. However, the present modification is an example of the elbow type power plug conversion unit. Therefore, detailed description on a configuration similar to the configuration of the above-mentioned eighth modification is omitted, and only a different portion will be described below in detail.

In the ninth modification, when a press operation is performed on one of the paired conversion plug blades 11G (in the direction of an arrow Y2 in FIG. 32), the one conversion plug blade 11G acts on one leaf spring contact piece 12G of the paired leaf spring contact pieces 12G, whereby the one leaf spring contact piece 12G is caused to sag so as to turn in the direction of an arrow R2 in FIG. 34. At the same time, the one conversion plug blade 11G moves the contact piece connecting plate 16G in the direction of the arrow Y2 in FIG. 32. As a result, the other leaf spring contact piece 12G of the paired leaf spring contact pieces 12G is also caused to turn and sag in the direction of the arrow R2 in FIG. 31. The action releases the engagement between the lock pawls 12*a* of the paired leaf spring contact pieces 12G and the through-holes 21*a* of the power plug blades 21 is released.

The power plug conversion unit 1G in the present modification has basically the same configuration as the configuration of the above-described eighth modification. The present modification differs in the configurations of a main body case 13G adapted to the elbow type, a power plug locking and unlocking mechanism (contact piece connecting plate 16G) provided inside the main body case 13G.

The power plug conversion unit 1G is mainly configured by a pair of conversion plug blades 11G which is a pair of second plug pins, a ground blade 15 which is a third plug pin, a pair of leaf spring contact pieces 12G which is a pair of plate-like spring members (not shown in FIG. 31; see FIGS. 32 to 34), the main body case 13G (conversion unit main body case), a fuse 18, the power plug locking and unlocking mechanism (contact piece connecting plate 16G), etc.

A proximal end portion of one conversion plug blade 11G of the paired conversion plug blades 11G is connected to one leaf spring contact piece 12G of the paired leaf spring contact pieces 12G inside the main body case 13G, and fixed so that a part of the proximal end portion is turnable with respect to the contact piece connecting plate 16G.

The other conversion plug blade 11G of the paired conversion plug blades 11G is connected to and fixed to one end of the fuse 18 inside the main body case 13G. The ground blade 15 is fixed to a fixed portion inside the main body case 13G.

Furthermore, the paired leaf spring contact pieces 12G are respectively fixed at predetermined positions inside the main body case 13G. Here, each of the paired leaf spring contact pieces 12G is arranged in the vicinity of each of the paired first plug pin insertion portions 13*c*. When each of the paired power plug blades 21 of the power plug 2 is inserted into each of the paired first plug pin insertion portions 13*c*, each of the paired power plug blades 21 is brought into contact with and electrically connected to each of the paired leaf spring contact pieces 12G (see the state shown in FIG. 32).

The distal end portion of each of the paired leaf spring contact pieces 12G is fixed to a part of the contact piece connecting plate 16G at a predetermined position. In other words, the paired leaf spring contact pieces 12G are connected to each other by the contact piece connecting plate 16G. Note that the contact piece connecting plate 16G is formed of a non-conductive member.

A clearance hole 13Gf configured to allow movement of the conversion plug blade 11G in the direction of the arrow R2 (the direction of the arrow Y2) is provided at a portion where the one conversion plug blade 11G penetrates and protrudes in main body case 13G. The other configuration is substantially the same as the configuration of the above-described eighth modification.

According to the configuration as described above, for example, the user applies an external load on one conversion plug blade 11G of the paired conversion plug blades 11G in the direction of the arrow R2 shown in FIG. 31 by using a finger or the like.

At that moment, the one conversion plug blade 11G receives the load, and turns in the direction of the arrow R2 as shown in FIG. 34. At this time, the one conversion plug blade 11G moves the contact piece connecting plate 16G in the direction of the arrow Y2. In conjunction with this movement, the distal end portions of the paired leaf spring contact pieces 12G also move in the same direction Y2 along with the contact piece connecting plate 16G to cause the distal end portions of the paired leaf spring contact pieces 12G to sag in the direction of the arrow Y2. As a result, as shown in FIG. 34, the engagement of the lock pawls 12*a* of the paired leaf spring contact pieces 12C with the respective through-holes 21*a* of the paired power plug blades 21 of the power plug 2 is released. Accordingly, the power plug 2 can be pulled out from the power plug conversion unit 1G.

According to the ninth modification as described above, substantially the same effect as the effect of the embodiment and the respective modifications described above can be obtained.

The present invention is not limited to the above-described embodiments, and it goes without saying that various modifications and applications can be implemented without departing from the subject matter of the invention. Furthermore, the above embodiments include inventions at various stages, and various inventions can be extracted by appropriate combinations of plural disclosed components. For example, even when some of the components are removed from all the components shown in the above embodiment, a configuration from which the components are eliminated can be extracted as an invention insofar as the configuration can solve the problem to be solved by the invention and attain the effects of the invention. Furthermore, components over different embodiments may be combined as appropriate. The invention is not limited by the specific embodiments except as limited by appended claims.

What is claimed is:

1. A power plug conversion unit comprising:

a power plug conversion unit main body;

a plurality of first plug pin insertion portions which are provided on one end surface of the power plug conversion unit main body and in which paired first plug pins of a power plug are respectively inserted;

a plurality of conversion plug pins which are arranged so as to project from another end surface of the power plug conversion unit main body, and at least one of which moves in a direction orthogonal to a projecting direction; and an attaching and detaching mechanism configured to lock attachment of the first plug pins when the paired first plug pins are inserted into the first plug pin insertion portions, and release the lock of the first plug pins when at least one pin of the conversion plug pins is moved in the direction orthogonal to the projecting direction while the paired first plug pins are inserted in the first plug pin insertion portions.

2. The power plug conversion unit according to claim 1, wherein the plurality of conversion plug pins have paired second plug pins and a third plug pin for ground, and the attaching and detaching mechanism releases the lock of the paired first plug pins when at least one of the second plug pins is moved while the paired first plug pins are inserted in the first plug pin insertion portions.

3. The power plug conversion unit according to claim 2, wherein the attaching and detaching mechanism includes:

paired plate-like spring members each of which is connected to a respective one of the paired second plug pins at one end portion of the plate-like spring member and is supported at another end portion of the plate-like spring member in a cantilever style by the power plug conversion unit main body;

a connecting member that is formed of a non-conductive member and connects the paired plate-like spring members; and a lock pawl that is formed in at least one of the paired plate-like spring members and engages with one of holes foamed respectively in the paired first plug pins when the paired first plug pins are inserted into the first plug pin insertion portions.

4. The power plug conversion unit according to claim 3, wherein the paired plate-like spring members are configured such that when the paired first plug pins are inserted into the first plug pin insertion portions, the lock pawl is pressed by at least one of the first plug pins, whereby at least one of the plate-like spring members sags, and the lock pawl engages with one of the holes provided in the first plug pins, and when one pin of the second plug pins is moved, the connecting member moves in conjunction with the movement of the one second plug pin, and the paired plate-like spring members sag to release the lock of the first plug pins.

5. The power plug conversion unit according to claim 2, wherein the attaching and detaching mechanism releases the lock of the first plug pins when the third plug pin is moved while the paired first plug pins are inserted in the first plug pin insertion portions.

6. The power plug conversion unit according to claim 3, wherein the paired plate-like spring members sag in a mutually approaching direction in conjunction with a moving operation of the paired second plug pins, thereby releasing the engagement between the lock pawl and the hole and releasing the lock of the first plug pins.

7. The power plug conversion unit according to claim 3, wherein the paired plate-like spring members sag in a mutually approaching direction in conjunction with a moving operation of the third plug pin, thereby releasing the engagement between the lock pawl and the hole and releasing the lock of the first plug pins.

8. The power plug conversion unit according to claim 2, further comprising a turning preventing member configured to prevent turning of the paired second plug pins in a mutually approaching direction.

9. The power plug conversion unit according to claim 8, wherein the turning preventing member is provided in a region sandwiched by the paired second plug pins on one surface of the power plug conversion unit main body.

10. The power plug conversion unit according to claim 8, wherein the turning preventing member is a cover member that is configured so as to be displaceable between a region sandwiched by the paired second plug pins and a position separated from the region sandwiched by the paired second plug pins by turning with respect to one surface of the power plug conversion unit main body.

11. The power plug conversion unit according to claim 8, wherein the turning preventing member is formed of an elastic member, and when the paired second plug pins are turned in the mutually approaching direction, the turning preventing member is compressed by the paired second plug pins, thereby allowing the paired second plug pins to turn.

* * * * *